US008260169B2

(12) United States Patent
Koido

(10) Patent No.: US 8,260,169 B2
(45) Date of Patent: Sep. 4, 2012

(54) DEVELOPER STORING CONTAINER, DEVELOPING UNIT, DEVELOPING DEVICE AND IMAGE FORMING APPARATUS CAPABLE OF REDUCING THE DEVELOPER FROM BEING SCATTERED

(75) Inventor: Shigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 473 days.

(21) Appl. No.: 12/071,662

(22) Filed: Feb. 25, 2008

(65) Prior Publication Data

US 2009/0016767 A1 Jan. 15, 2009

(30) Foreign Application Priority Data

Feb. 28, 2007 (JP) ..... 2007-049006

(51) Int. Cl.
*G03G 15/08* (2006.01)

(52) U.S. Cl. ..... 399/106; 399/103; 399/260

(58) Field of Classification Search ..... 399/102–106, 399/258, 260, 262, 263
See application file for complete search history.

(56) References Cited

U.S. PATENT DOCUMENTS

| | | | | |
|---|---|---|---|---|
| 2005/0169672 | A1* | 8/2005 | Ban et al. | 399/258 |
| 2006/0280526 | A1* | 12/2006 | Shimomura | 399/258 |

FOREIGN PATENT DOCUMENTS

| | | | |
|---|---|---|---|
| JP | 6-214461 | | 8/1994 |
| JP | 06214461 | A * | 8/1994 |
| JP | 2005-227402 | | 8/2005 |
| JP | 2006-139069 | | 6/2006 |
| JP | 2006-220877 | | 8/2006 |
| JP | 2006-243446 | | 9/2006 |

OTHER PUBLICATIONS

Machine English Translation of JP06-214461.*

* cited by examiner

*Primary Examiner* — Walter L Lindsay, Jr.
*Assistant Examiner* — Billy J Lactaoen
(74) *Attorney, Agent, or Firm* — Rabin & Berdo, P.C.

(57) ABSTRACT

A developer storing container includes a developer storing body having a first opening, and a shutter member capable of taking a closing position and an opening position to close and open the first opening. The shutter member includes a first seal member including a seal portion provided along the first opening and an extending portion extending from the seal portion in the opening direction of the shutter member. A distance from an end portion of the first opening in the opening direction to an end of the extending portion when the shutter member is in the closing position is longer than a distance of an end portion of an exposable portion of the first seal member (exposed via the first opening when the shutter member is in the closing position) when the shutter member moves from the closing position to the opening position.

29 Claims, 23 Drawing Sheets

DEVELOPER STORING CONTAINER, DEVELOPING UNIT, DEVELOPING DEVICE AND IMAGE FORMING APPARATUS CAPABLE OF REDUCING THE DEVELOPER FROM BEING SCATTERED

BACKGROUND OF THE INVENTION

This invention relates to a developing device that develops a latent image formed on a photosensitive body using a developer. This invention also relates to a developer storing container and a developing unit used in the developing device, and an image forming apparatus employing the developing device.

A conventional toner cartridge includes an outer cartridge that stores the toner therein and has a toner supply opening. The conventional toner cartridge also includes a shutter provided to open and close the toner supply opening of the outer cartridge. The shutter is configured to close the toner supply opening via a sealing sponge when the shutter is in a closing position. When the toner cartridge is mounted to the developing unit and when the toner supply opening is to be opened, the shutter is moved to an opening position where an opening formed on the shutter is aligned with the toner supply opening of the outer cartridge to thereby supply the toner to the developing unit (see, for example, Patent Document No. 1).

Patent Document No. 1: Japanese Laid-Open Patent Publication No. 2006-243446 (Page 6, FIG. 1).

However, in the above described conventional toner cartridge, the toner may adhere to the surface of the sealing sponge of the shutter and to a circumference of the toner supply opening of the outer cartridge. In such a case, when the toner cartridge is detached from the developing unit, the toner may be scattered and may contaminate the surroundings.

SUMMARY OF THE INVENTION

The present invention is intended to solve the above described problems, and an object of the present invention is to provide a developer storing cartridge, a developing unit, a developing device and an image forming apparatus capable of preventing the developer from being scattered and preventing the developer from contaminating the surroundings when a toner cartridge is attached to a developing unit.

The present invention provides a developer storing container detachably attached to a developing unit. The developer storing container includes a developer storing body that stores a developer therein and has a first opening, and a shutter member provided in the developer storing body so that the shutter member is movable along an inner surface of a wall of the developer storing body where the first opening is formed. The shutter member is capable of taking a closing position for closing the first opening and an opening position for opening the first opening. The shutter member includes a first seal member including a seal portion provided at least along the first opening when the shutter member is in the closing position, and an extending portion extending from the seal portion in an opening direction in which the shutter member opens the first opening. A distance from an end portion of the first opening in the opening direction to an end of the extending portion when the shutter member is in the closing position is longer than a distance moved by an end portion in the opening direction of an exposable portion of the first seal member (i.e., a portion of the first seal member exposed via the first opening when the shutter member is in the closing position) when the shutter member moves from the closing position to the opening position.

With such an arrangement, it becomes possible to prevent the developer from adhering to the outer surface of the seal member of the shutter member and from adhering to the circumference of the first opening of the developer storing body. Therefore, it becomes possible to prevent the developer from being scattered from the developer storing unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, an embodiment of the present invention will be described with reference to the attached drawings.

Embodiment 1

Figure 1:
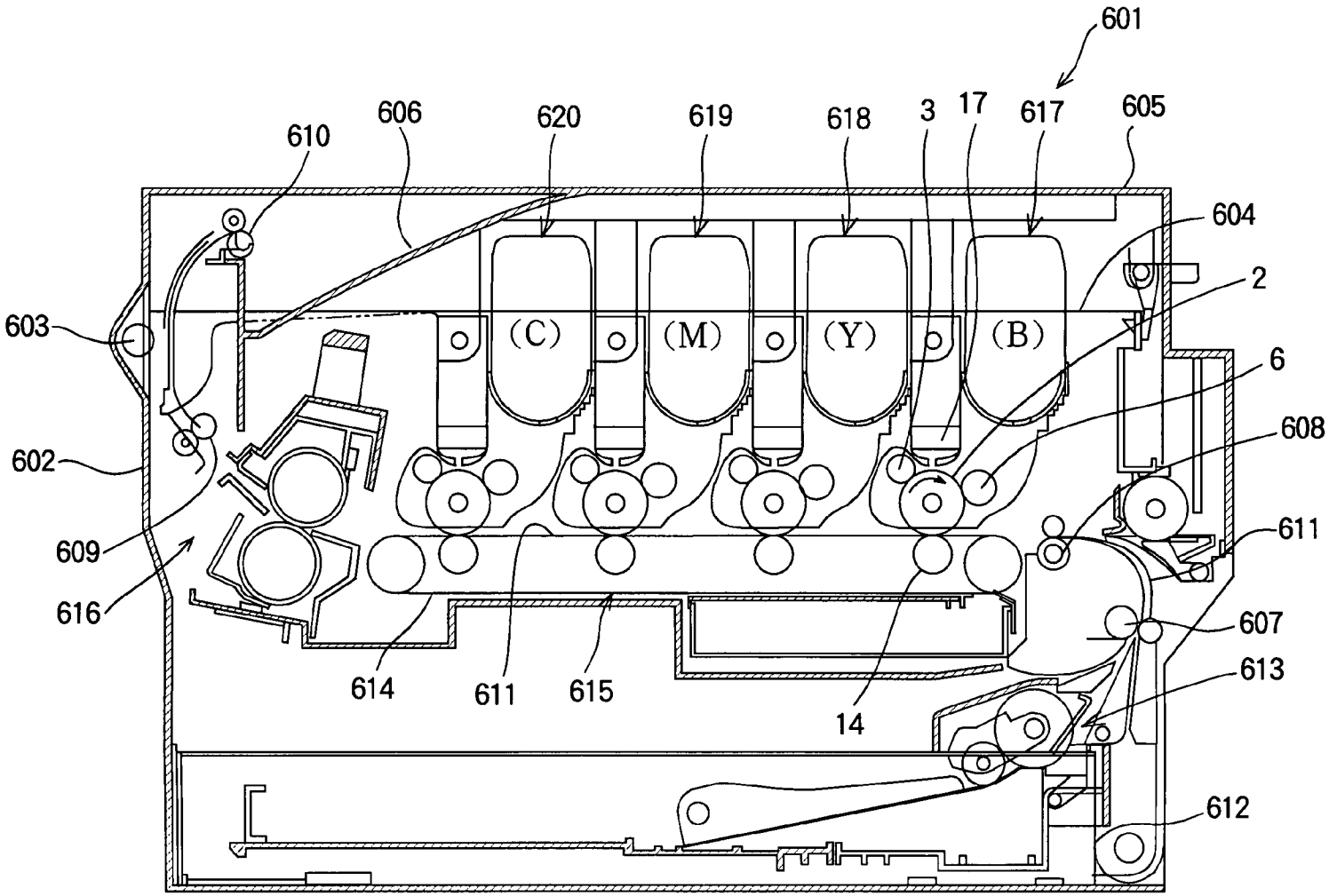
FIG. 1 is a sectional view showing an image forming apparatus according to Embodiment 1 of the present invention.

FIG. 1 is a sectional view showing an image forming apparatus according to Embodiment 1 of the present invention.

As shown in FIG. 1, the image forming apparatus 601 is configured as an electrophotographic color printer capable of printing images of black (K), yellow (Y), magenta (M) and cyan (C). The image forming apparatus 601 includes a lower cover 602 and an openable-and-closable upper cover 605 swingably mounted to the lower cover 602 via a parting surface 604. A stacker 606 is provided on the upper cover 605 to which a recording sheet (with an image having been formed) is ejected. A substantially S-shaped sheet feeding path 611 is formed inside the lower cover 602. Sheet feeding rollers 607, 608, 609 and 610 are arranged along the sheet feeding path 611. A sheet cassette 612 storing the recording sheets therein is disposed on the upstream end of the sheet feeding path 611. The above described stacker 606 is disposed on the downstream end of the sheet feeding path 611.

A sheet supply portion 613, a transfer belt unit 615 and a fixing unit 616 are disposed along the sheet feeding path 611. The sheet supply portion 613 picks up the recording sheet stored in the sheet cassette 612 and supplies the sheet to the sheet feeding path 611. The transfer belt unit 615 feeds the recording sheet while absorbing the recording sheet via an electrostatic effect. The fixing unit 616 fixes a toner image (having been transferred to the recording sheet as described later) to the recording sheet. Detachable developing devices 617, 618, 619 and 620 are disposed along a straight line in this order from the upstream side to the downstream side in the feeding direction of the recording sheet. The developing devices 617, 628, 619 and 620 face the transfer belt unit 615 with the sheet feeding path 611 intervened therebetween. The developing devices 617, 618, 619 and 620 store the toners (i.e., developers) of black (K), yellow (Y), magenta (M) and cyan (C). In this embodiment, the respective developing devices 617, 618, 619 and 620 have the same configurations except the colors of the stored toners.

Along the circumference of a photosensitive drum 2 of each of the developing device 617 through 620, a charging roller 3, an LED head 17, a developing roller 6, a transfer roller 14 and the like are arranged in this order from the upstream side to the downstream side of the rotational direction of the photosensitive drum 2. The LED head 17 is mounted to the upper cover 605, and the transfer roller 14 is mounted to the main body of the image forming apparatus to which the developing devices 617 through 620 are mounted. Each of the developing devices 617 through 620 is formed as one unit, and is detachably mounted to the main body of the image forming apparatus 601. In this regard, the term "main body" is used to mean a portion of the image forming apparatus from which detachable or movable components (such as the sheet cassette 612, the developing devices 617 through 620, the upper cover 605 or the like) are removed.

Figure 2:
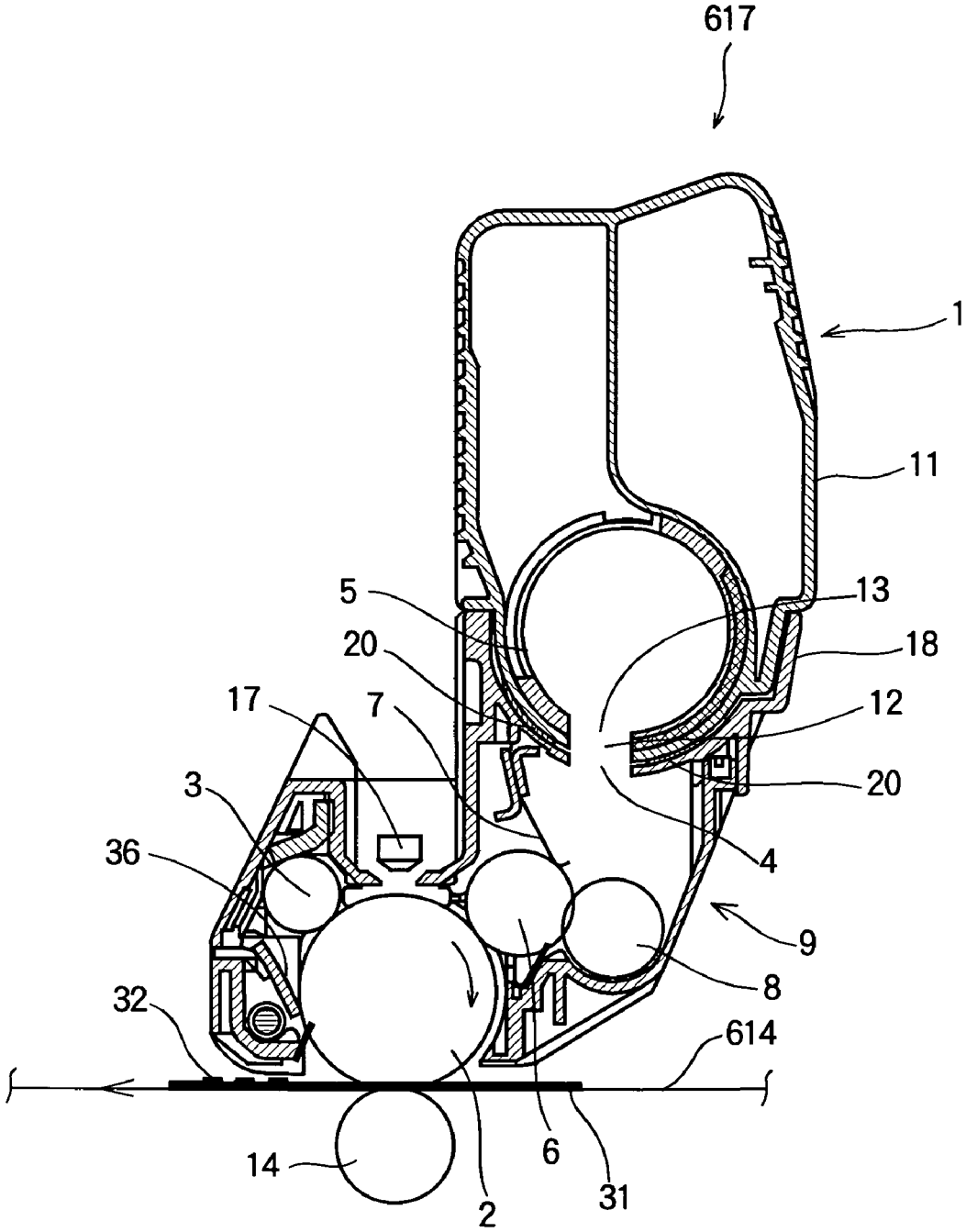
FIG. 2 is a sectional view showing an internal structure of a developing device according to Embodiment 1 together with an LED head, a transfer roller and a transfer belt.

FIG. 2 is a sectional view showing the internal structure of the developing device 617 together with the LED head 17 (mounted to the upper cover 605), the transfer roller 14 and the transfer belt 61 (mounted to the main body of the image forming apparatus 601). The developing devices 617 through 620 have the same internal structures, and therefore the internal structure of the developing device 617 storing black toner will be explained as an example with reference to FIG. 2.

The developing device 617 includes a toner cartridge 1 (i.e., a developer storing container) that stores the toner therein and a developing unit 9 to which the toner cartridge 1 is detachably mounted as described later. A photosensitive drum 2 is provided inside the developing unit 9. The charging roller 3, the LED head 17 (mounted to the upper cover 605 shown in FIG. 1), the developing roller 6 and the transfer roller 14 (mounted to the main body of the image forming apparatus 601 shown in FIG. 1) or the like are arranged along the circumference of the photosensitive drum 2 in this order from the upstream to the downstream in the rotating direction of the photosensitive drum 2 as indicated by an arrow in FIG. 2. The photosensitive drum 2 is rotatable at a predetermined rotational speed, and is able to have an electric charge on the surface thereof. The electric charge on the surface of the photosensitive drum 2 is removed by exposure. The charging roller 3 is applied with a predetermined voltage and is rotatably urged against the surface of the photosensitive drum 2 at a constant pressure so as to electrically charge the surface of the photosensitive drum 2. The LED head 17 selectively exposes the charged surface of the photosensitive drum 2, to thereby form a latent image.

The toner cartridge 1 is mounted to a mounting portion 81 (i.e., a developer storing container mounting portion) of the developing unit 9. A toner replenishing opening 4 (i.e., a third opening) is provided on the mounting portion 18. A seal member (i.e., a second seal member) 20 is disposed on the upper surface of the mounting portion 18, and surrounds the toner replenishing opening 4. The upper surface of the seal member 20 contacts the outer cartridge 11 of the toner cartridge 1, so as to seal between the toner cartridge 1 and the developing unit 9 from outside. By rotating the shutter 5 of the toner cartridge 1 to align an opening 13 (i.e., a second opening) of the shutter 5 and a toner supply opening 12 (i.e., a first opening) of the outer cartridge 11, the toner supply opening 12 is opened, and the toner in the outer cartridge 11 is supplied to the developing unit 9 via the toner replenishing opening 4 of the developing unit 9.

A toner supply roller 8 and a developing blade 7 are provided in the developing unit 9. The toner supply roller 8 rotates in contact with the surface of the developing roller 6, and supplies the toner (supplied from the toner cartridge 1) to the developer 6. The developing blade 7 regulates the thickness of the toner supplied to the developing roller 6 by the toner supply roller 8. The developing roller 6 disposed in the developing unit 9 is urged against the photosensitive drum 2 at a constant pressure, so as to cause the toner to adhere to the latent image on the photosensitive drum 2. A cleaning blade 36 formed of a resilient body is so disposed that the edge portion thereof is urged against the surface of the photosensitive drum 2 at a constant pressure for scraping off the residual toner on the surface of the photosensitive drum 2.

As shown in FIG. 1, the transfer rollers 14 are respectively composed of electrically conductive rubbers, and are disposed so as to face the respective photosensitive drums 2 of the above described developing devices 617, 618, 619 and 620. The transfer rollers 14 are urged against the photosensitive drums 2 via a transfer belt 614 that absorbs the recording sheet 31 (FIG. 2) via electrostatic force and feeds the recording sheet 31. The transfer rollers 14 transfer the toner images on the respective photosensitive drums 2 to the recording sheet 31 (FIG. 2). Each transfer roller 14 is applied with an electric potential so that a predetermined potential difference respectively generates between a surface potential of the transfer roller 14 and a surface potential of the photosensitive drum 2 facing the transfer roller 14.

The fixing unit 616 includes a heat roller and a backup roller provided therein, and applies heat and pressure to a toner image 32 having been transferred to the recording sheet 31 (FIG. 2) so that the toner image 32 is fixed to the recording sheet 31. The recording sheet 31 to which the toner image is fixed is fed by the sheet feeding rollers 609 and 610 (provided at the downstream side of the fixing unit 616) to the stacker 606.

Figure 3:
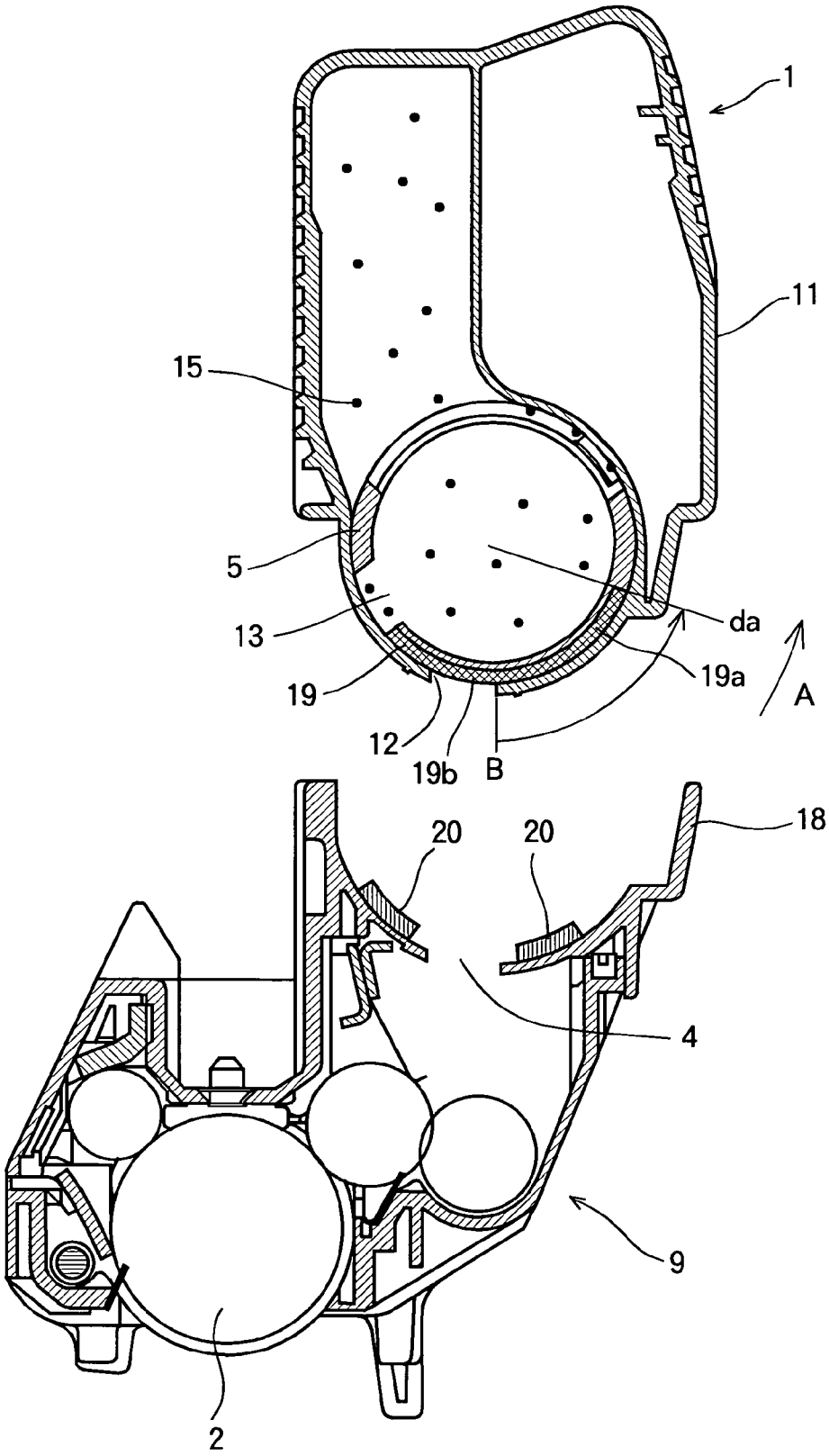
FIG. 3 is a sectional view showing a main part of the developing device according to Embodiment 1 in a state where a toner cartridge is detached from a developing unit.

FIG. 3 is a sectional view showing the developing device 617 according to Embodiment 1 of the present invention in a state where the toner cartridge 1 is detached from the developing unit 9. The configuration of the developing device will be described with reference to FIG. 3.

As shown in FIG. 3, the outer cartridge 11 (i.e., a developer storing body) that stores the toner 15 therein has the toner supply opening 12 (i.e., the first opening). A cylindrical shutter 5 for opening and closing the toner supply opening 12 is provided in the outer cartridge 11. The toner supply opening 12 is rotatable in contact with an inner surface of a wall of the outer cartridge 11 on which the toner supply opening 12 is formed. In the axial direction of the photosensitive drum 2, the toner cartridge 1 has, for example, substantially the same width as the photosensitive drum 2 which is wider than the width of the recording sheet. The toner supply opening 12 is an elongated hole which is formed substantially throughout the length of the toner cartridge 1.

The shutter 5 includes a seal sponge 19 (i.e., a first seal member) that covers the toner supply opening 12 when the shutter 5 is in a closing position to close the toner supply opening 12, and the seal sponge 19 resiliently contacts the inner circumferential surface of the outer cartridge 11. The seal sponge 19 includes a seal portion that closes the toner supply opening 12 and an extending portion 19*a* extending from the seal portion in the opening direction of the shutter 5 (indicated by an arrow A in FIG. 3). The seal sponge 19 is fixed to the shutter 5 by means of a double-sided adhesion tape. The shutter 5 has the opening 13 (i.e., the second opening) facing the toner supply opening 12. The toner supply opening 12 and the opening 13 have substantially the same size.

Figure 4:
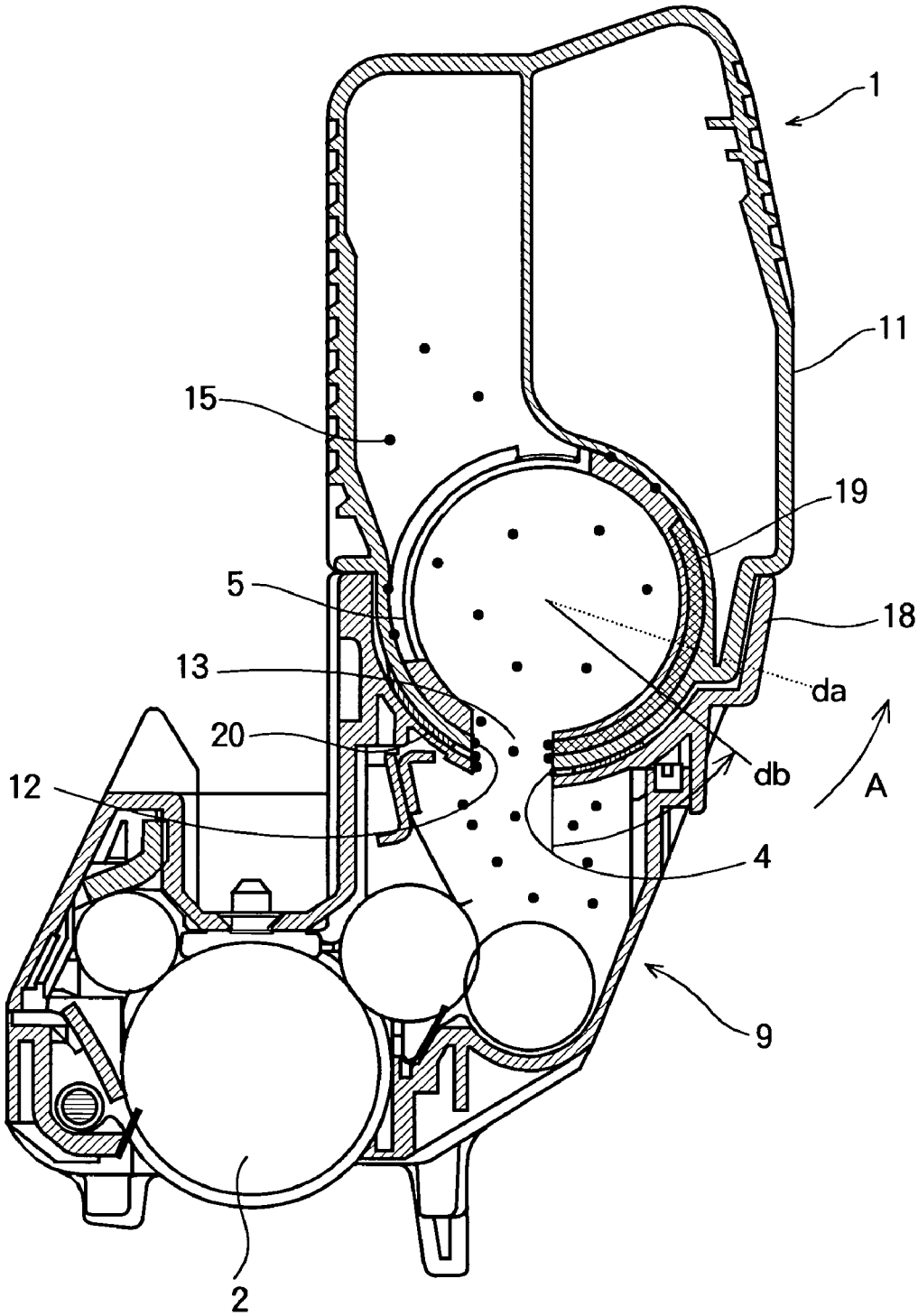
FIG. 4 is a sectional view showing an opening-and-closing operation of a shutter of the toner cartridge according to Embodiment 1.
Figure 5:
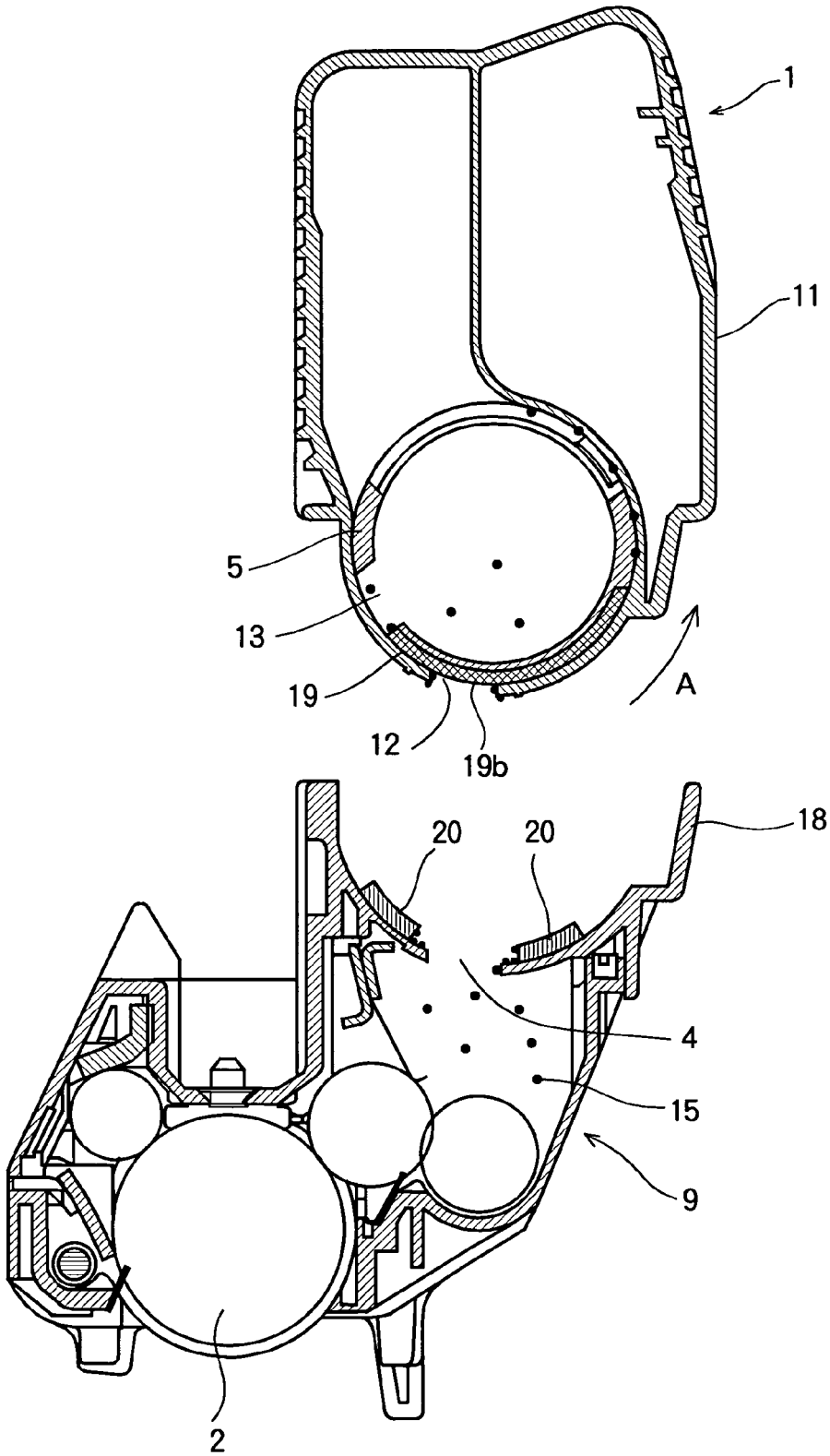
FIG. 5 is a sectional view showing a state where the toner cartridge is detached from the developing unit according to Embodiment 1.

The opening-and-closing operation of the shutter 5 of the above configured toner cartridge 11 will be described with reference to FIG. 3 and FIGS. 4 and 5 showing the respective operation steps.

FIG. 3 shows a state where the toner cartridge 1 and the developing unit 9 are not yet in use and where the shutter 5 of the toner cartridge 1 is in the closing position in Embodiment 1. In this state, the toner supply opening 12 of the outer cartridge 11 (storing the toner therein) of the toner cartridge 1 is closed by the seal sponge 19 of the shutter 5. Further, the seal sponge 19 extending to the extending portion 19*a* in the opening direction of the shutter 5 closes the toner supply opening 12. In this state, an arcuate distance from an end surface (in the opening direction of the shutter 5 shown by the arrow A) of the toner supply opening 12 of the outer cartridge 11 to an end portion of the extending portion 19*a* of the seal sponge 19 is referred to the distance "da".

The seal sponge 19 contacts the inner surface of the outer cartridge 11, and therefore the toner 15 does not intrude into between the seal sponge 19 and the outer cartridge 11. However, no sealing effect is exerted in an area where the shutter 5 directly contacts the inner surface of the outer cartridge 11, and therefore the toner 15 may intrude into between the shutter 5 and the outer cartridge 11 of this area. Here, an end portion (in the opening direction of the shutter 5) of an exposable surface 19*b* of the seal sponge 19 closing the toner supply opening 12 of the outer cartridge 11 is referred to as an end portion "B".

FIG. 4 is a sectional view showing a state where the toner cartridge 1 is mounted to the mounting portion 18 of the developing unit 9 in Embodiment 1. In this state, the seal member 20 (see FIG. 3) provided on the mounting portion 18 contacts the outer cartridge 11 of the toner cartridge 1, and seals between the toner cartridge 1 and the developing unit 9 from outside. As shown in FIG. 3, the seal member 20 is fixed to the upper surface of the mounting portion 18 by means of a double-sided adhesion tape so that the seal member 20 surrounds the toner replenishing opening 4.

When the shutter 5 is moved by a not shown mechanism in the direction shown by the arrow A from the closing position (FIG. 3) to the opening position (FIG. 4), the opening 13 of the shutter 5 is substantially aligned with the toner supply opening 12 of the outer cartridge 11. In this state, the toner 15 in the toner cartridge 1 is supplied to the interior of the developing unit 9 via the toner replenishing opening 4 of the mounting portion 18 of the developing unit 9. In this regard, the toner replenishing opening 4 is an elongated hole formed on an area substantially aligned with the opening 13 of the shutter 5 in a state where the toner cartridge 1 is mounted to the developer unit 9 and the shutter 5 is in the opening position as shown in FIG. 4.

According to the opening operation of the shutter 5, the seal sponge 19 moves in contact with the inner circumferential surface of the outer cartridge 1 from the closing position (FIG. 3) to the opening position (FIG. 4). The arcuate distance moved by the end portion B of the exposable surface 19*b* of the seal sponge 19 from the end surface (in the opening direction of the shutter 5 shown by the arrow A) of the toner supply opening 12 when the shutter 5 moves from the closing position to the opening position is referred to as a distance "db". There is a relationship: da>db. When the shutter 5 is in the closing position shown in FIG. 3, the toner 12 does not intrude into between the seal sponge 19 and the outer cartridge 11 due to the existence of the extending portion 19*a* of the seal sponge 19 in the area of the distance "da" from the end surface of the toner supply opening 12. Accordingly, even when the shutter 5 rotates to the opening position shown in FIG. 4, the toner does not adhere to the exposable surface 19*b* of the seal sponge 19.

FIG. 5 is a sectional view showing a state where the toner cartridge 1 is detached from the developing unit 9 in Embodiment 1. After the shutter 5 is closed (i.e., moved back to the closing position), the toner cartridge 1 is detached from the developing unit 9. The toner does not adhere to the exposable surface 19*b* of the seal sponge 19 as described above, and therefore the toner 15 in the outer cartridge 11 does not leak out from the toner supply opening 12.

Next, a comparative example with respect to Embodiment 1 of the present invention will be described.

Figure 6:
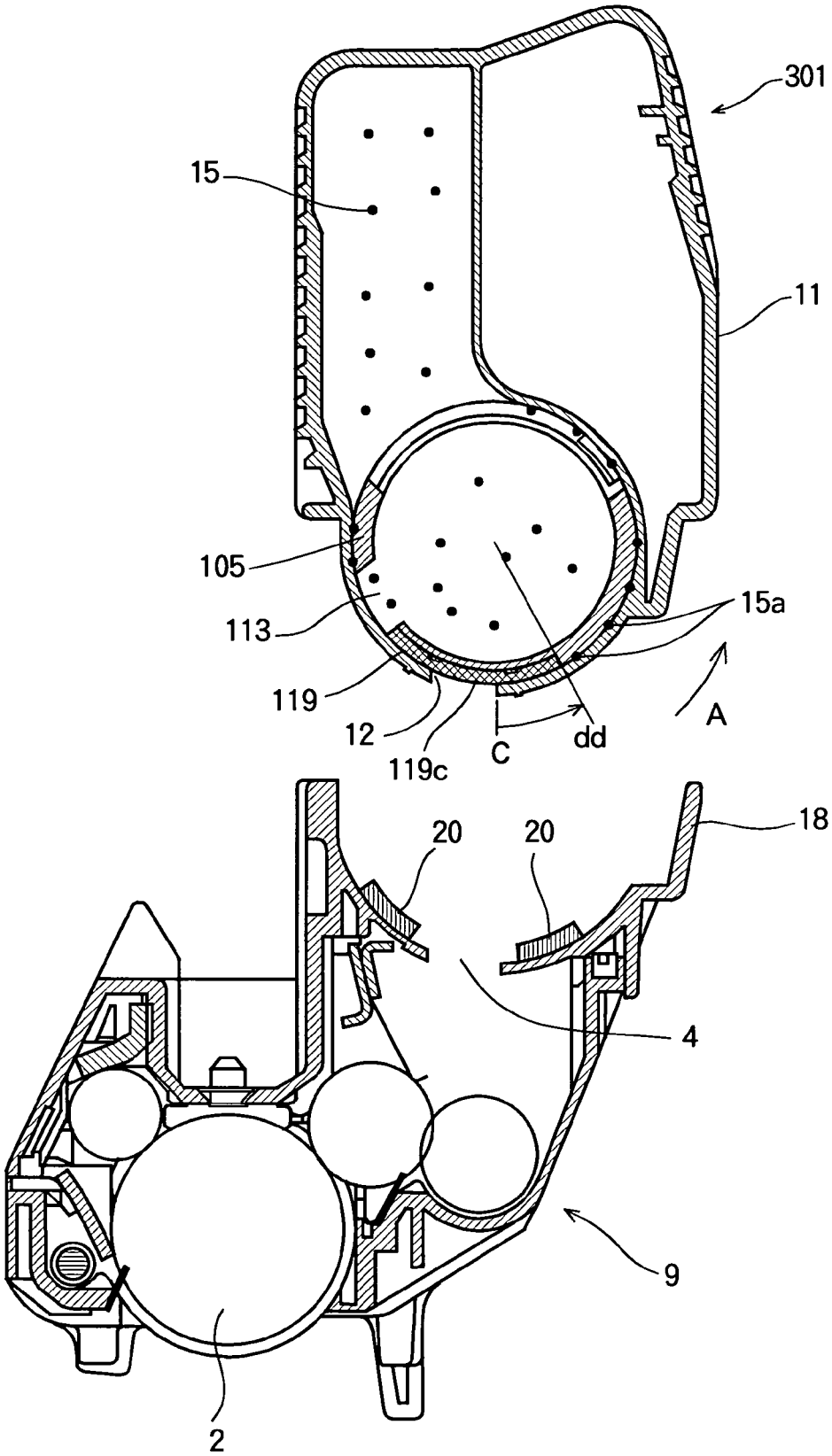
FIG. 6 is a sectional view showing a developing device of a comparative example in a state where a toner cartridge is detached from a developing unit.
Figure 7:
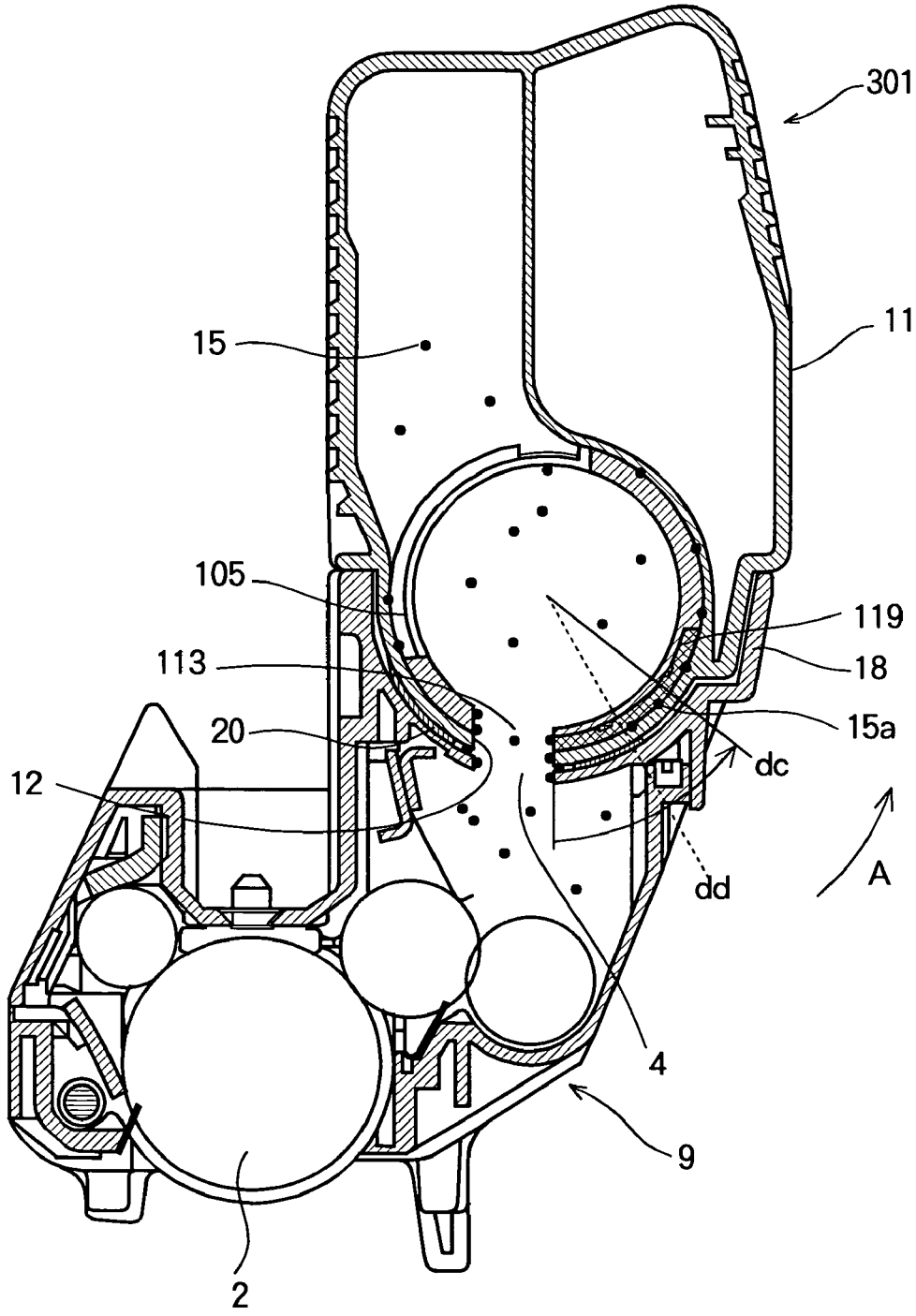
FIG. 7 is a sectional view showing an opening-and-closing operation of a shutter of the toner cartridge of the comparative example.
Figure 8:
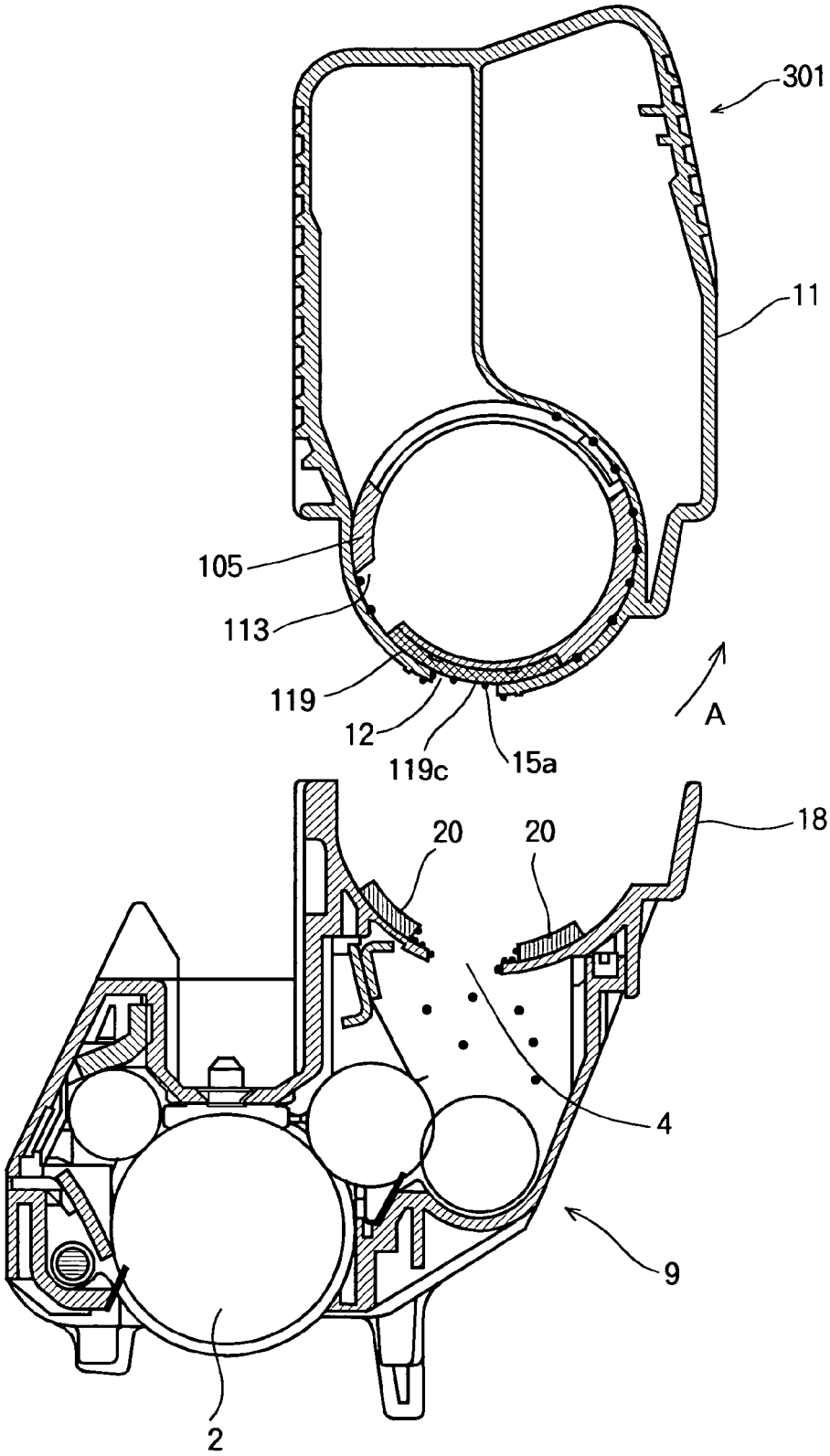
FIG. 8 is a sectional view showing a state where the toner cartridge is detached from the developing unit according to the comparative example.

FIG. 6 through 8 show the configuration and the operation of a toner cartridge 301 of a comparative example. The toner cartridge 301 of the comparative example has a seal sponge 119 (different from the seal sponge 19 of Embodiment 1) having no extending portion 19*a*. The components other than the seal sponge are the same as those of the toner cartridge 1 of Embodiment 1, and description thereof are omitted.

FIG. 6 is a sectional view showing a state where the toner cartridge 301 and the developing unit 9 are not yet in use, and where the shutter 105 of the toner cartridge 301 is in the closing position to close the toner supply opening 12 in the comparative example. In this state, the toner supply opening 12 of the outer cartridge 11 (storing the toner 15) of the toner cartridge 301 is closed by the seal sponge 119 of the shutter 105. In this state, an arcuate distance from the end surface (in the opening direction of the shutter 105 shown by the arrow A) of the toner supply opening 12 to the end portion of the seal sponge 119 is referred to the distance "dd". An end portion (in the opening direction of the shutter 105) of the exposable surface 119*b* of the seal sponge 119 sealing the toner supply opening 12 of the outer cartridge 11 is referred to as an end portion "C".

FIG. 7 is a sectional view showing a state where the toner cartridge 301 is mounted to the mounting portion 18 of the developing unit 9 in the comparative example. In this state, the seal member 20 (see FIG. 3) provided on the mounting portion 18 contacts the outer cartridge 11 of the toner cartridge 301, and seals between the toner cartridge 301 and the developing unit 9 from outside. According to the opening operation of the shutter 105, the seal sponge 119 moves in contact with the inner circumferential surface of the outer cartridge 11 from the closing position (FIG. 6) to the opening position (FIG. 7). The arcuate distance moved by the end portion C of the exposable surface 19*b* of the seal sponge 119 shown in FIG. 21 from the end surface (in the opening direction of the shutter 105 shown by the arrow A) of the toner supply opening 12 of the outer cartridge 11 due to the opening operation of the shutter 105 is referred to as a distance "dc". There is a relationship: dd<dc.

In the area from the distance "dd" to the distance "dc", the shutter 105 directly contacts the outer cartridge 11 when the shutter 105 is in the closing position, and therefore no sealing effect is exerted. Therefore, the toner may intrude between the shutter 105 and the outer cartridge 11 in this area as indicated by numeral 15*a* in FIG. 6. Such toner 15*a* may adhere to the exposable surface 119*c* of the seal sponge 119 in the area from the distance "dd" to the distance "dc" when the shutter 105 is in the opening position.

FIG. 8 is a sectional view showing a state where the toner cartridge 301 is detached from the developing unit 9 in the comparative example. After the shutter 105 is moved back to the closed position, the toner cartridge 301 is detached from the developing unit 9. Since the toner 15 (for example, indicated by numeral 15*a*) adheres to the exposable surface 119*c* of the seal sponge 119 as described above, the scattering of the toner 15 may occur.

As described above, according to the developing device of Embodiment 1, the seal sponge 19 of the shutter 5 closing the toner supply opening 12 of the outer cartridge 11 is provided with the extending portion 19*a* extending in the opening direction of the shutter 5. Further, the distance "da" from the end surface of the toner supply opening 12 (in the opening direction of the shutter 5) in a state where the shutter 5 is in the closing position to the end portion of the extending portion 19*a* of the seal sponge 19 is greater than the distance "db" moved by the end portion B of the exposable surface 19*b* of the seal sponge 19 (in a state where the shutter 5 is in the closing position) when the shutter 5 moves from the closing position to the opening position. Therefore, it becomes possible to prevent the toner from adhering to the exposable surface 19*b* of the seal sponge 19. Accordingly, it becomes possible to prevent the toner from being scattered from the surface of the seal sponge 19, and to prevent the toner from contaminating the surroundings.

Embodiment 2

Figure 9:
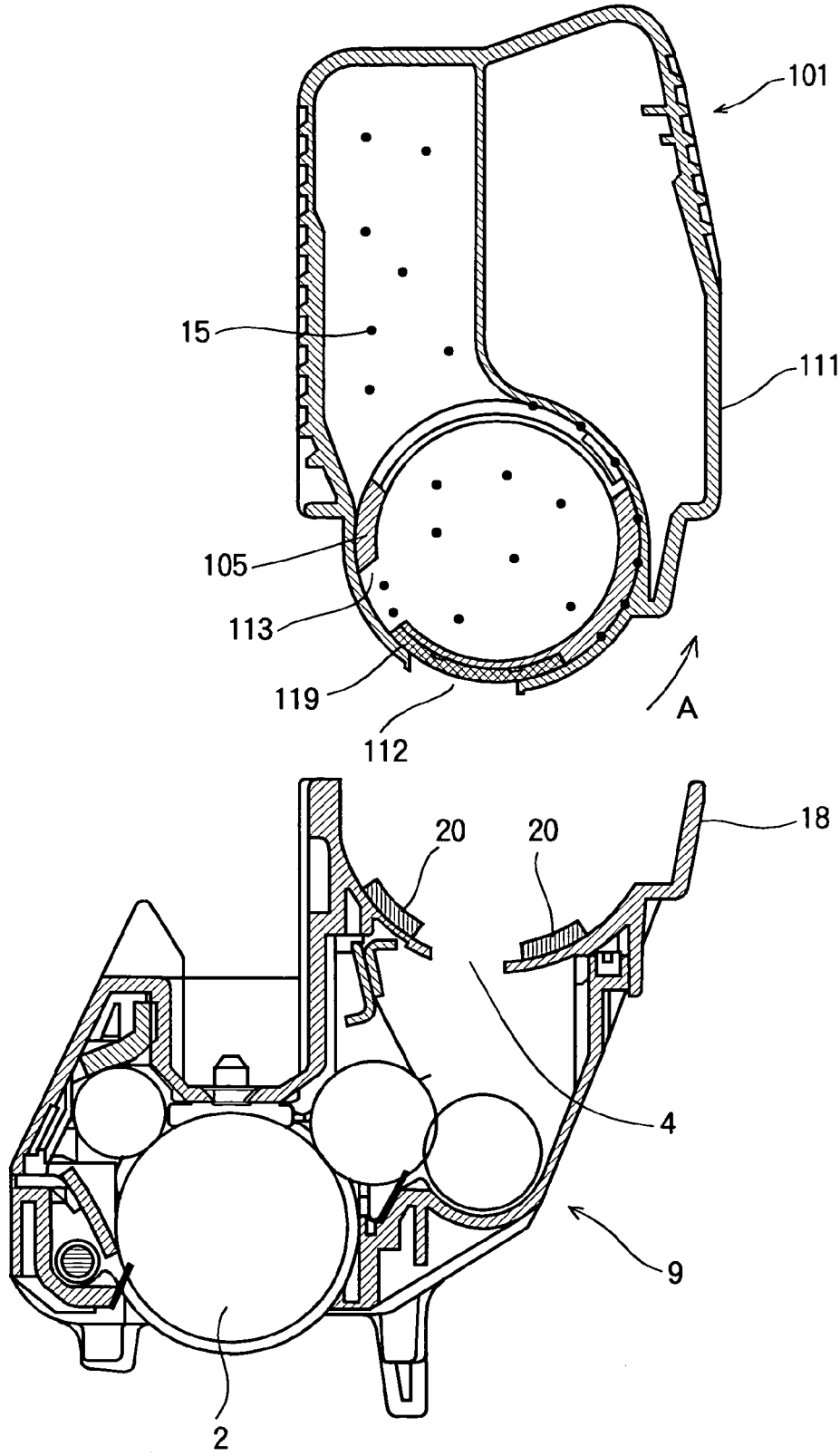
FIG. 9 is a sectional view showing a developing device according to Embodiment 2 in a state where a toner cartridge is detached from a developing unit.

FIG. 9 is a sectional view showing a developing device in an image forming apparatus according to the Embodiment 2 of the present invention in a state where a toner cartridge 101 is detached from the developing unit 9.

The image forming apparatus of Embodiment 2 is different from the image forming apparatus 601 of Embodiment 1 (FIG. 1) in the structures of a shutter 105 and a toner supply opening 112 of the toner cartridge 101. Parts of the image forming apparatus of Embodiment 2 that are the same as those of the image forming apparatus 601 of Embodiment 1 (FIG. 1) are assigned the same reference numerals. Here, the description is focused on the difference between the image forming apparatus of Embodiment 2 and the image forming apparatus 601 of Embodiment 1.

As shown in FIG. 9, the toner cartridge 101 includes an outer cartridge 111 for storing the toner 15 and having a toner supply opening 112. The cylindrical shutter 105 for opening and closing the toner supply opening 112 of the outer cartridge 111 is rotatably provided in contact with the inner circumferential surface of the wall of the outer cartridge 111 on which the toner supply opening 112 is formed. In the axial direction of the photosensitive drum 2, the toner cartridge 111 has, for example, substantially the same width as the photosensitive drum 2 which is wider than the width of the recording sheet. The toner supply opening 112 is an elongated hole formed substantially throughout the length of the toner cartridge 101.

The shutter 105 includes a seal sponge 119 (i.e., a first seal member) that covers the toner supply opening 112 when the shutter 105 is in the closing position to close the toner supply opening 112, and the seal sponge 119 resiliently contacts the inner circumferential surface of the outer cartridge 111. The seal sponge 119 is fixed to the shutter 105 by means of a double-sided adhesion tape. The shutter 105 has an opening 113 disposed at a position corresponding to the toner supply opening 112 in a state where the shutter 105 is in the opening position (see FIG. 10) to open the toner supply opening 112. The toner supply opening 112 of the outer cartridge 111 is larger than the opening 113 of the shutter 105. In particular, the width of the toner supply opening 112 (i.e., the dimension perpendicular to the longitudinal direction) of the outer cartridge 111 is wider than that of the opening 113 of the shutter 105.

Figure 10:
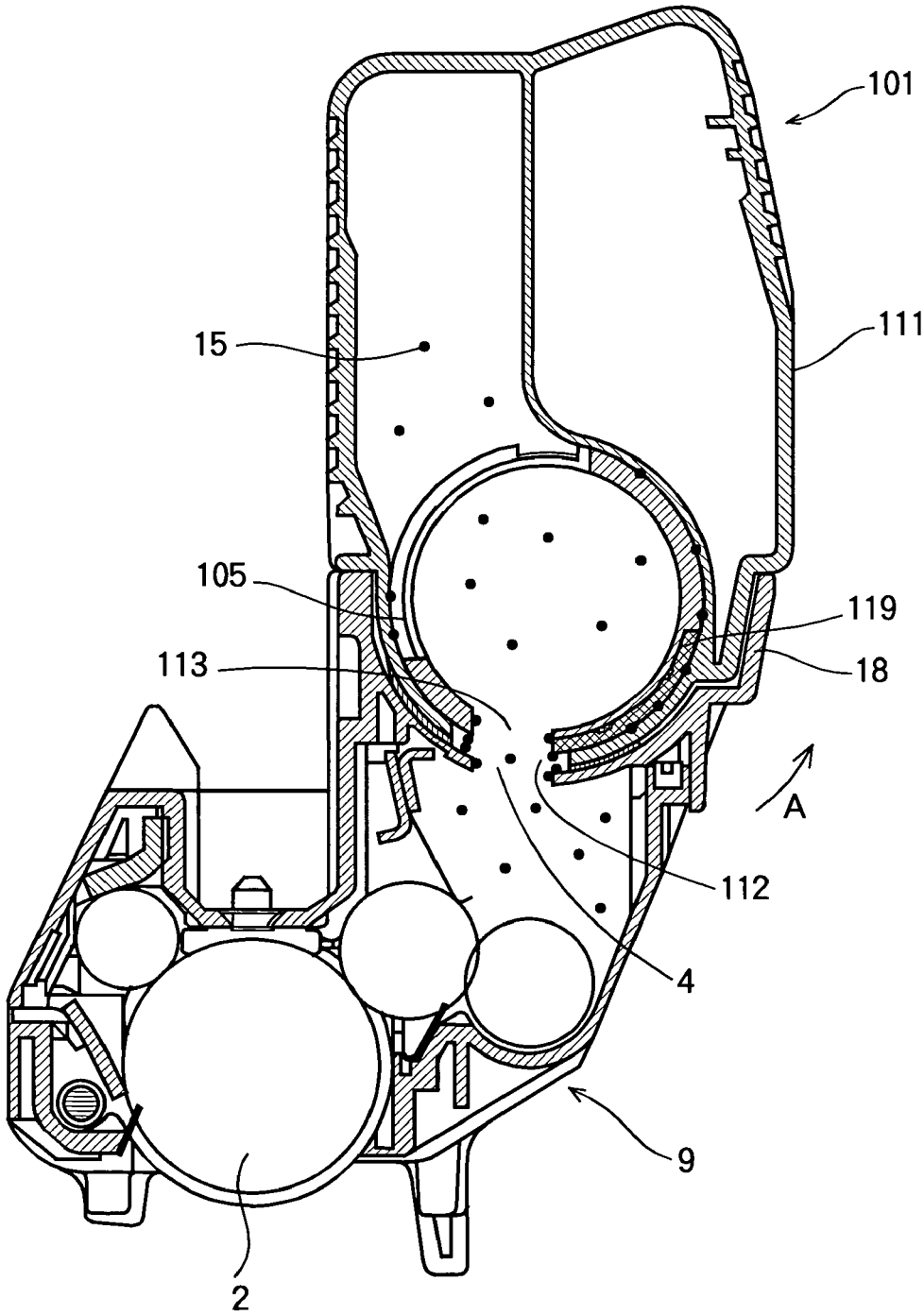
FIG. 10 is a sectional view showing an opening-and-closing operation of a shutter of the toner cartridge according to Embodiment 2.
Figure 11:
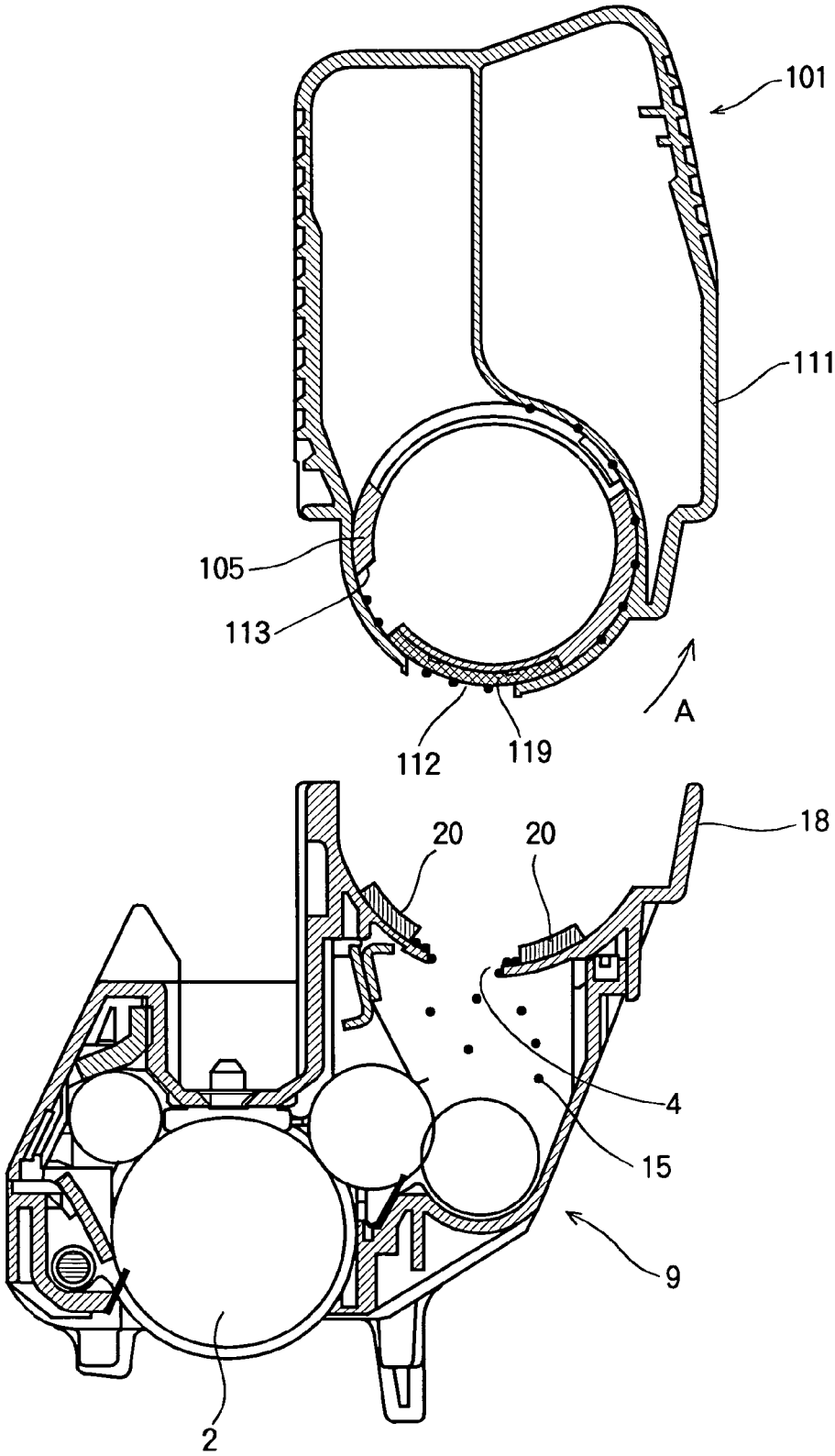
FIG. 11 is a sectional view showing a state where the toner cartridge is detached from the developing unit according to Embodiment 2.

The opening-and-closing operation of the shutter 105 of the above configured toner cartridge 101 will be described with reference to FIG. 9 and FIGS. 10 and 11 showing the respective operation steps.

FIG. 9 shows a state where the toner cartridge 101 and the developing unit 9 are not yet in use and where the shutter 105 of the toner cartridge 101 is in the closing position to close the toner supply opening 112 in Embodiment 2. In the toner cartridge 101 of this state, the toner supply opening 112 of the outer cartridge 111 (storing the toner therein) which is larger than the opening 113 of the shutter 105 is closed by the seal sponge 119 of the shutter 105.

FIG. 10 is a sectional view showing a state where the toner cartridge 101 is mounted to the mounting portion 18 of the developing unit 9 in Embodiment 2. In this state, the seal member 20 (see FIG. 9) disposed on the mounting portion 18 contacts the outer cartridge 111 of the toner cartridge 101, and seals between the toner cartridge 101 and the developing unit 9 from outside. When the shutter 105 is moved by a not shown mechanism in the direction shown by the arrow A from the closing position (FIG. 9) to the opening position (FIG. 10), the opening 113 of the shutter 105 reaches the position which is substantially the same as the toner supply opening 112 of the outer cartridge 111, and the toner 15 in the toner cartridge 111 is supplied to the developing unit 9 via the toner replenishing opening 4 provided on the mounting portion 18 of the developing unit 9.

In this state, the toner supply opening 112 of the outer cartridge 111 is larger than (more specifically, has a width wider than) the opening 113 of the shutter 105. In other words, the inner circumferential surface of the toner supply opening 112 is in the retracted position with respect to a supplying path of the toner 15. With such an arrangement, when the toner 15 is supplied to the developing unit 9, it is less likely that the toner 15 adheres to the inner circumferential surface of the toner supply opening 112.

FIG. 11 shows a state where the toner cartridge 101 is detached from the developing unit 9 in Embodiment 2. The shutter 105 is moved back to the closing position, and the toner cartridge 101 is detached. In this state, since the toner 15 does not adhere to the inner circumferential surface of the toner supply opening 112 as described above, the scattering of the toner from the inner circumferential surface of the toner supply opening 112 can be prevented.

As described above, according to the developing device of Embodiment 2, the toner supply opening 112 of the outer cartridge 111 is larger than (more specifically, has a width wider than) the opening 113 of the shutter 105, and therefore the toner 15 does not adhere to the inner circumferential surface of the toner supply opening 112. Therefore, it becomes possible to prevent the toner from being scattered toner from the inner circumferential surface of the toner supply opening 112, and to prevent the toner from contaminating the surroundings.

Embodiment 3

Figure 12:
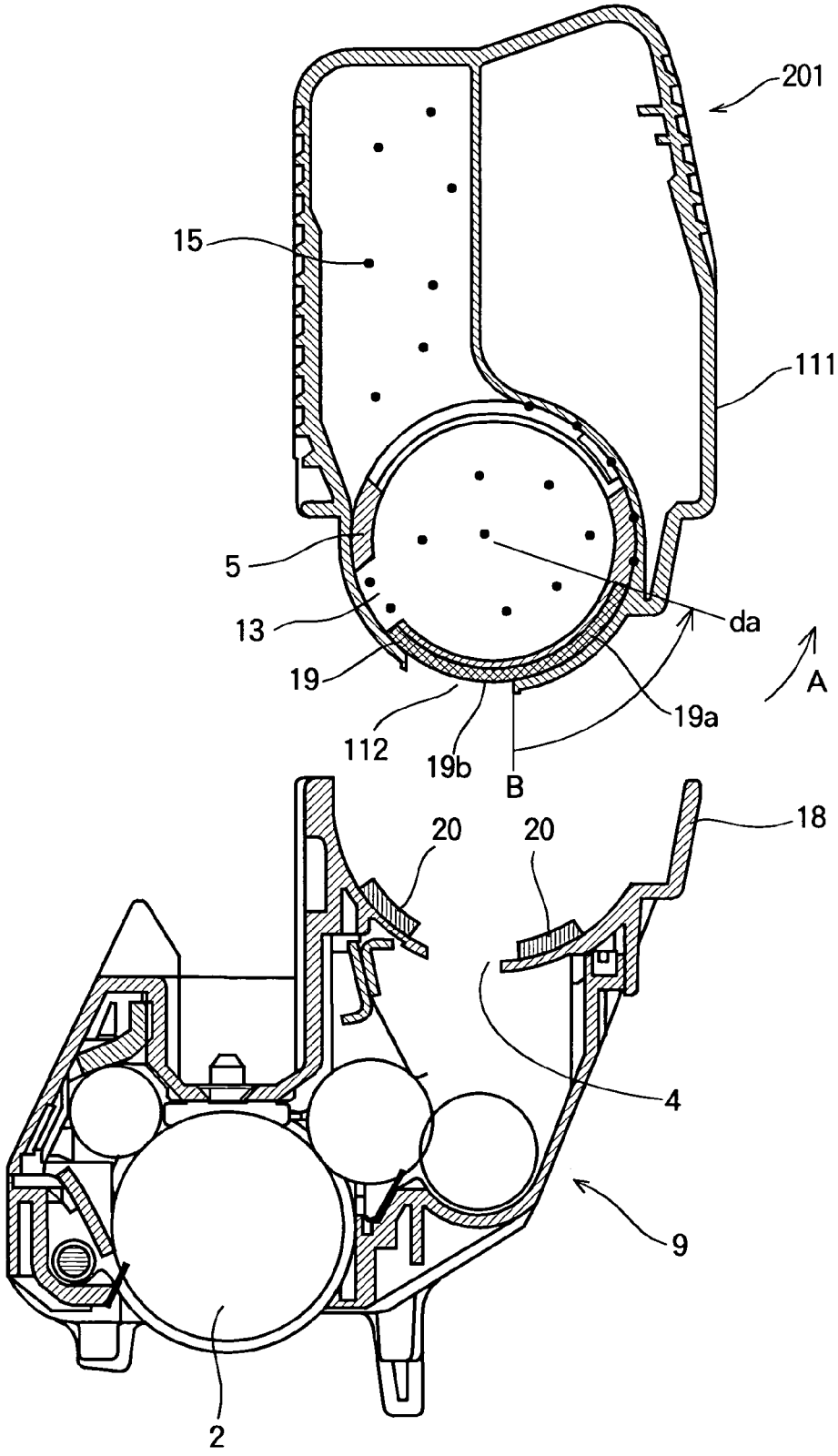
FIG. 12 is a sectional view showing a developing device according to Embodiment 3 in a state where a toner cartridge is detached from a developing unit.

FIG. 12 is a sectional view showing a developing device of an image forming apparatus according to Embodiment 3 of the present invention in a state where a toner cartridge 201 is detached from the developing unit 9.

The image forming apparatus of Embodiment 3 is different from the image forming apparatus 601 of Embodiment 1 (FIG. 1) in that the developing device of Embodiment 3 is configured so that the toner supply opening 112 of the outer cartridge 111 is larger than the opening 113 of the shutter 5 of the toner cartridge 201. In other words, the developing device of Embodiment 3 has the seal sponge 19 provided with the extending portion as was described Embodiment 1, and has the toner supply opening 112 larger than the opening 113 of the shutter 105 as was described in Embodiment 2. Therefore, parts of the image forming apparatus of Embodiment 3 that are the same as those of the image forming apparatus of Embodiment 1 or 2 are assigned the same reference numerals. Here, the description is focused on the difference between the image forming apparatus of Embodiment 3 and the image forming apparatus of Embodiments 1 and 2.

As shown in FIG. 12, the shutter 5 includes a seal sponge 19. The seal sponge 19 covers the toner supply opening 112 when the shutter 5 is in the closing position to close the toner supply opening 112, and the seal sponge 19 resiliently contacts the inner circumferential surface of the outer cartridge 111. The seal sponge 19 includes a seal portion that closes the toner supply opening 112 and an extending portion extending in the opening direction of the shutter 5 (shown by the arrow A) from the seal portion. The seal sponge 19 is fixed to the shutter 5 by means of a double-sided adhesive tape. The shutter 5 has an opening 13 provided in a position corresponding to the toner supply opening 112 in a state where the shutter 5 is in the opening position (see FIG. 10) to open the toner supply opening 112. The shutter opening 112 of the outer cartridge 111 is larger than the opening 13 of the shutter 5. To be more specific, the width (i.e., the dimension perpendicular to the longitudinal direction) of the toner supply opening 112 of the outer cartridge 111 is wider than the opening 113 of the shutter 105.

Figure 13:
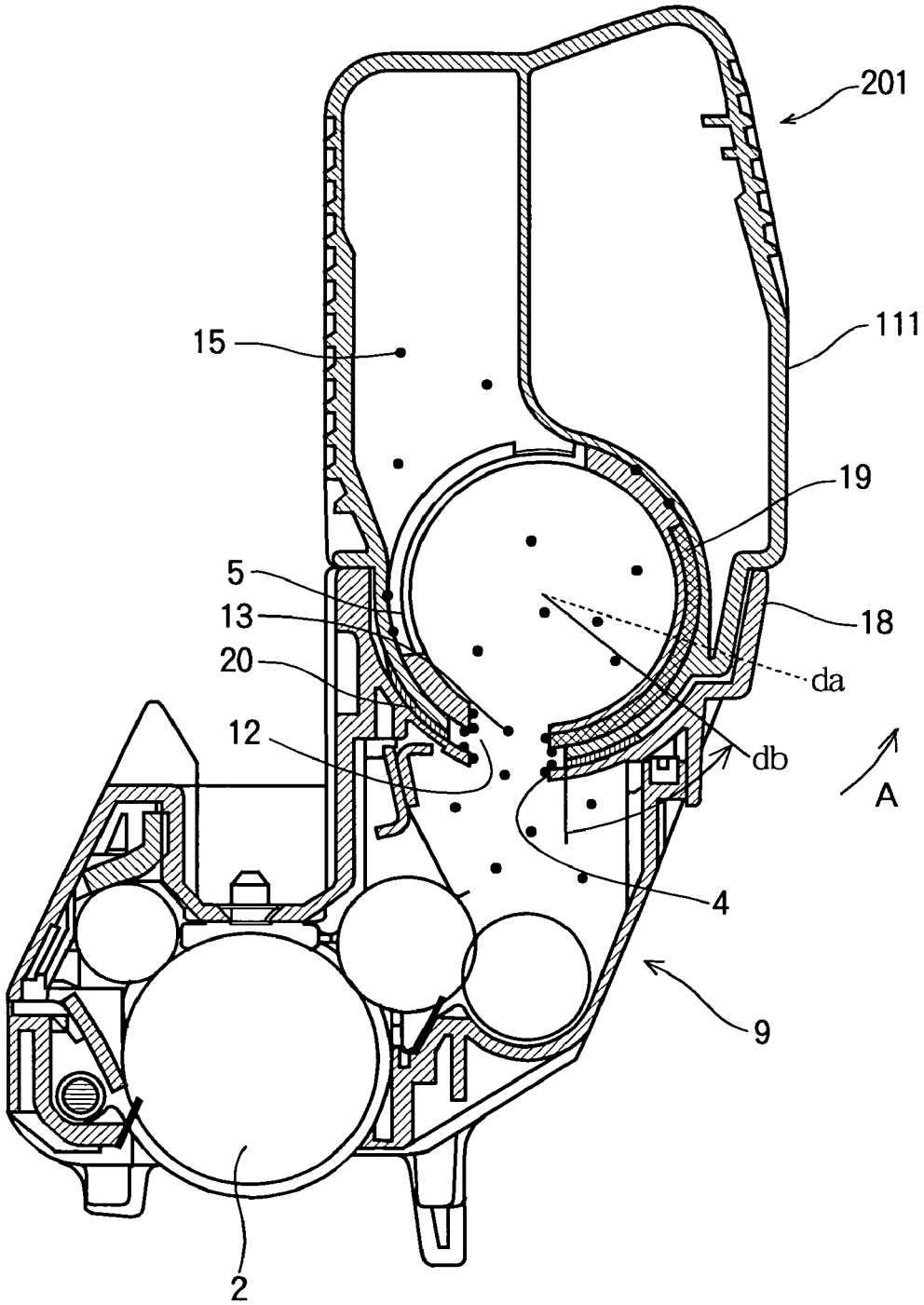
FIG. 13 is a sectional view showing an opening-and-closing operation of a shutter of the toner cartridge according to Embodiment 3.
Figure 14:
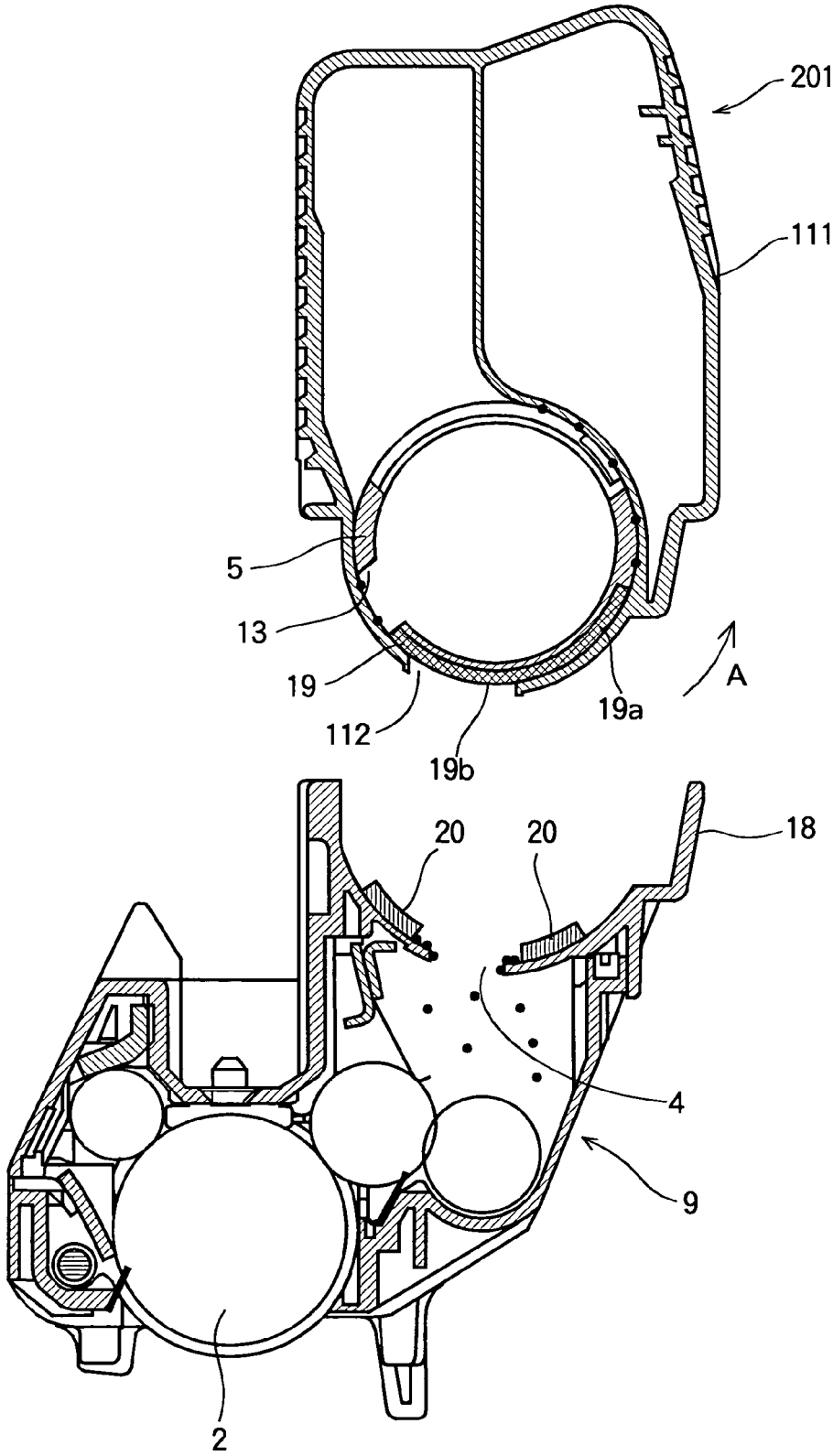
FIG. 14 is a sectional view showing a state where the toner cartridge is detached from the developing unit according to Embodiment 3.

The opening-and-closing operation of the shutter 5 of the above configured toner cartridge 201 will be described with reference to FIG. 12 and FIGS. 13 and 14 showing the respective operation steps.

FIG. 12 shows a state where the toner cartridge 201 and the developing unit 9 are not yet in use and where the shutter 5 of the toner cartridge 201 is in the closing position to close the toner supply opening 112 in Embodiment 3. In this state, the toner supply opening 112 of the outer cartridge 111 (storing the toner therein) of the toner cartridge 201 is closed by the seal sponge 19 of the shutter 5.

The seal sponge 19 resiliently contacts the inner circumferential surface of the outer cartridge 111, and therefore the toner 15 does not intrude into between the seal sponge 19 and the outer cartridge 111. However, no sealing effect is exerted in an area where the shutter 5 directly contacts the inner surface of the outer cartridge 111, and therefore the toner 15 may intrude into between the shutter 5 and the outer cartridge 111 in this area. Here, an end portion (in the opening direction of the shutter 5 shown by the arrow A) of the exposable surface 19*b* of the seal sponge 19 closing the toner supply opening 112 of the outer cartridge 111 is referred to as an end portion "B".

FIG. 13 is a sectional view showing a state where the toner cartridge 201 is mounted to the mounting portion 18 of the developing unit 9 in Embodiment 3. In this state, the seal member 20 (see FIG. 12) disposed on the mounting portion 18 contacts the outer cartridge 111 of the toner cartridge 201, and seals between the toner cartridge 201 and the developing unit 9 from outside. When the shutter 5 is moved by a not shown mechanism in the direction shown by the arrow A from the closing position (FIG. 12) to the opening position (FIG. 13), the opening 13 of the shutter 5 reaches the position which is the same as the toner supply opening 112 of the outer cartridge 111, and the toner 15 in the toner cartridge 201 is supplied to the developing unit 9 via the toner replenishing opening 4 provided on the mounting portion 18 of the developing unit 9.

According to the opening operation of the shutter 5, the seal sponge 19 moves in contact with the inner circumferential surface of the outer cartridge 111 from the closing position shown in FIG. 12 to the opening position shown in FIG. 13. The arcuate distance moved by the end portion B of the exposable surface 19*b* of the seal sponge 19 due to the opening operation of the shutter 5 from the end surface (in the opening direction of the shutter 5 shown by the arrow A) of the toner supply opening 112 of the outer cartridge 111 is referred to as a distance "db". There is a relationship: da>db. When the shutter 5 is in the closing position shown in FIG. 12, the intrusion of the toner 15 into between the seal sponge 19 and the outer cartridge 111 is prevented by the extending portion 19*a* of the seal sponge 19 existing in the area of the distance "da" from the end surface of the toner supply opening 112. Accordingly, even when the shutter 5 rotates to the opening position shown in FIG. 13, the toner does not adhere to the exposable surface 19*b* of the seal sponge 19.

Further, the toner supply opening 112 of the outer cartridge 111 is larger than (more specifically, has a width wider than) the opening 113 of the shutter 5. In other words, the inner circumferential surface of the toner supply opening 112 is in the retracted position with respect to the supplying path of the toner 15. With such an arrangement, when the toner 15 is supplied to the developing unit 9, it is less likely that the toner 15 adheres to the inner circumferential surface of the toner supply opening 112.

FIG. 14 is a sectional view showing a state where the toner cartridge 201 is detached from the developing unit 9 in Embodiment 3. After the shutter 5 is moved back to the closing position, the toner cartridge 201 is detached from the developing unit 9. In this state, since the toner 15 does not adhere to the exposable surface 19*b* of the seal sponge 19, and since the toner 15 does not adhere to the inner circumferential surface of the toner supply opening 112 as described above, it becomes possible to prevent the toner 15 from leaking out of the outer cartridge 111 via the toner supply opening 112.

As described above, according to the developing device of Embodiment 3, the adhesion of the toner to the exposable surface 19*b* of the seal sponge 19 is prevented, and the adhesion of the toner to the inner circumferential surface of the toner supply opening 112 is prevented, with the result that it becomes possible to prevent the toner from being scattered and to prevent the toner from contaminating the surroundings.

Embodiment 4

Figure 15:
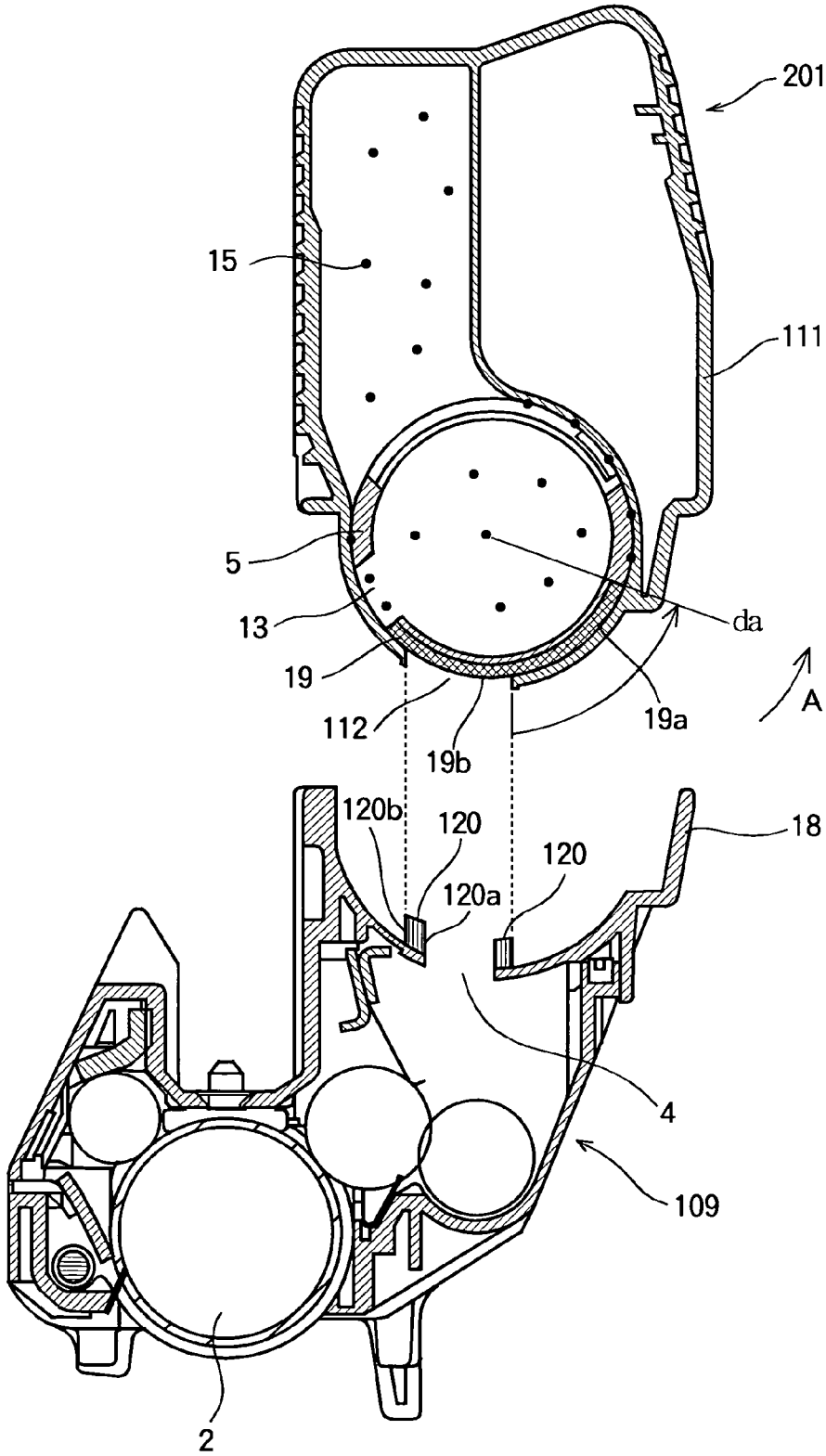
FIG. 15 is a sectional view showing a developing device according to Embodiment 4 in a state where a toner cartridge is detached from a developing unit.

FIG. 15 is a sectional view showing a developing device of an image forming apparatus according to Embodiment 4 of the present invention in a state where the toner cartridge 201 is detached from a developing unit 109.

The image forming of Embodiment 4 is different from the image forming apparatus 601 (FIG. 1) of Embodiment 1 in employing the toner cartridge 201 of Embodiment 3 (as the toner cartridge of the developing device of Embodiment 4) while changing the shape and position of the seal member 120. Therefore, parts of the image forming apparatus of Embodiment 4 that are the same as those of the image forming apparatus of Embodiment 1 or 3 are assigned the same reference numerals. Here, the description is focused on the difference between the image forming apparatus of Embodiment 4 and the image forming apparatus of Embodiments 1 and 3.

In FIG. 15, the toner cartridge 201 is configured as was described in Embodiment 3, and therefore a description thereof is omitted. The developing unit 109 has a seal member 120 on the upper surface of the mounting portion 18 to which the toner cartridge 201 is mounted. The seal member 120 is fixed to the mounting portion 18 by means of a double-sided adhesion tape so that the seal member 120 surrounds the toner replenishing opening 4. The seal member 120 has an inner circumferential surface 120*a* and an outer circumferential surface 120*b*. An area surrounded by the inner circumferential surface 120*a* is substantially the same as a cross-sectional area of the opening 13 of the shutter 5 of the toner cartridge 201, and is substantially the same as a cross-sectional area of the toner replenishing opening 4 of the developing unit 109. An area surrounded by the outer circumferential surface 120*b* is substantially the same as a cross-sectional area of the toner supply opening 112.

Figure 16:
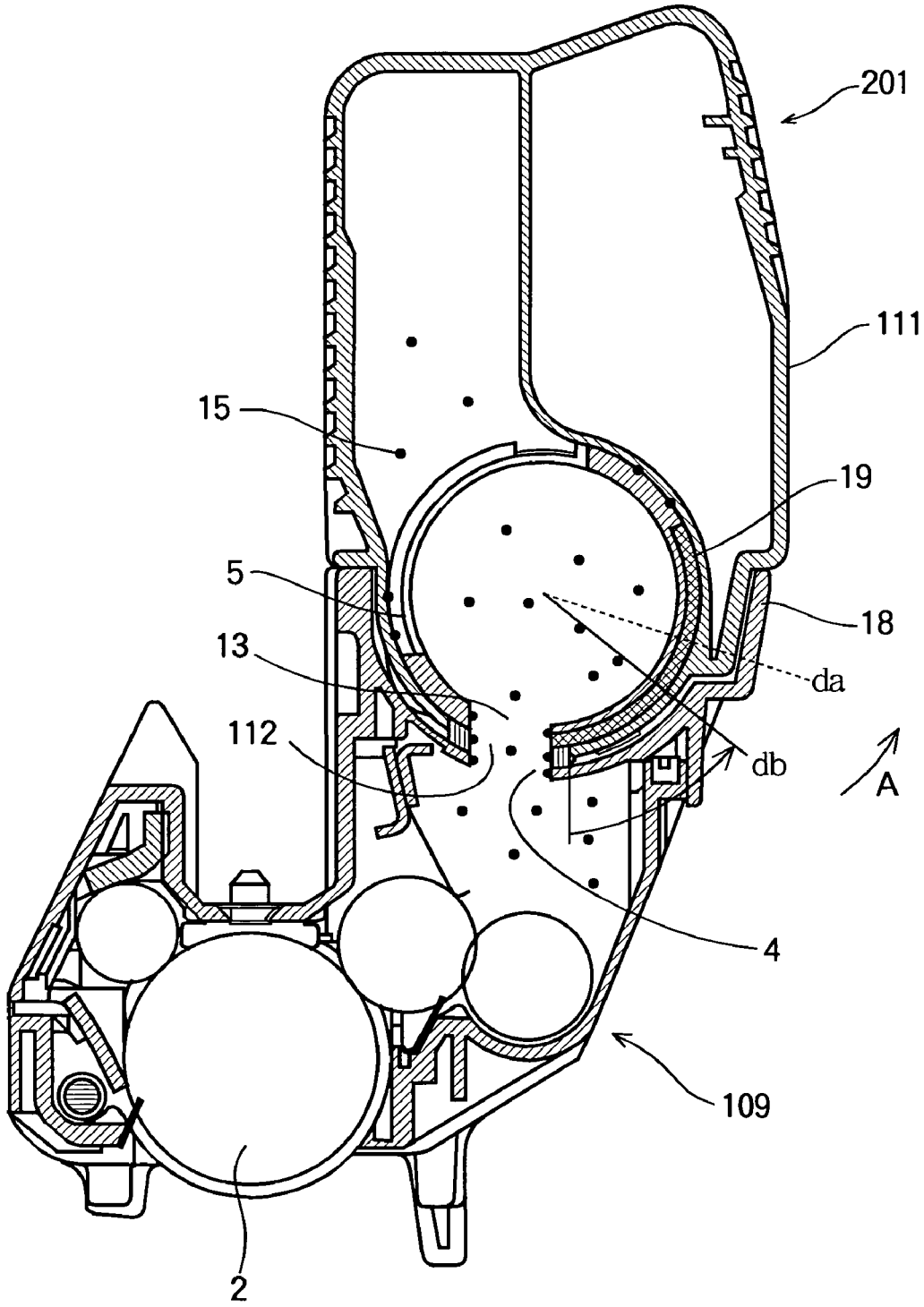
FIG. 16 is a sectional view showing an opening-and-closing operation of a shutter of the toner cartridge according to Embodiment 4.
Figure 17:
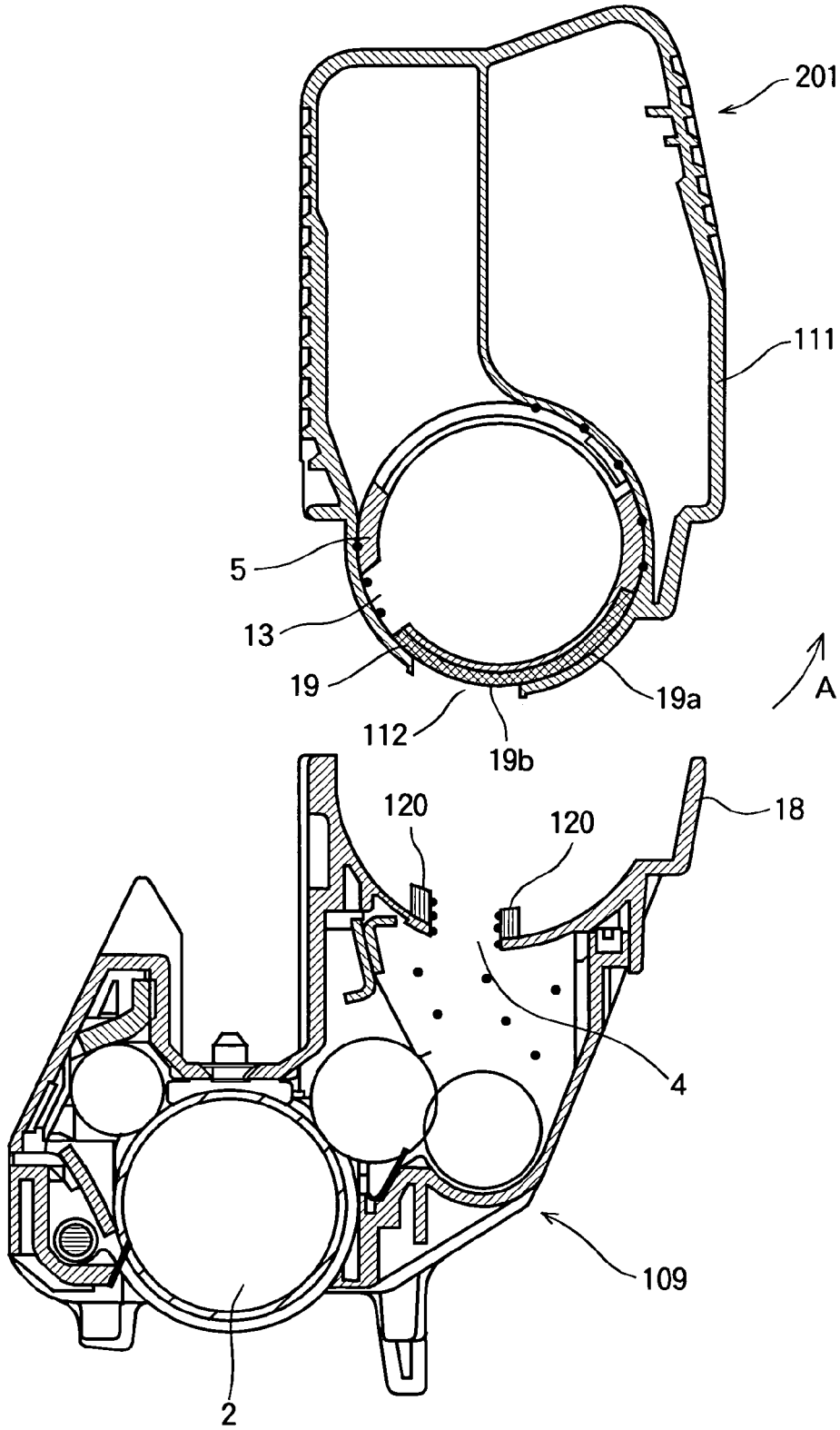
FIG. 17 is a sectional view showing a state where the toner cartridge is detached from the developing unit according to Embodiment 4.

The opening-and-closing operation of the shutter 5 of the above configured toner cartridge 201 will be described with reference to FIG. 15 and FIGS. 16 and 17 showing the respective operation steps.

FIG. 15 shows a state where the toner cartridge 201 and the developing unit 109 are not yet in use and where the shutter 5 of the toner cartridge 201 is in the closing position to close the toner supply opening 112 in Embodiment 4. In this state, the toner supply opening 112 of the outer cartridge 111 (storing the toner therein) of the toner cartridge 201 is closed by the seal sponge 19 of the shutter 5.

FIG. 16 is a sectional view showing a state where the toner cartridge 201 is mounted to the mounting portion 18 of the developing unit 109 in Embodiment 4. The toner supply opening 112 of the outer cartridge 111 is larger than the opening 13 of the shutter 5, and is substantially aligned with the outer surface of the seal member 120. Therefore, the seal member 120 of the developing unit 109 is inserted into the toner supply opening 112, and the upper surface of the seal member 120 contacts the shutter 5 and the seal sponge 19 of the toner cartridge 201, so as to seal between the toner cartridge 201 and the developing unit 109 from outside.

When the shutter 5 is moved by a not shown mechanism in the direction shown by the arrow A from the closing position (FIG. 15) to the opening position (FIG. 16), the opening 13 of the shutter 5 is substantially aligned with the toner supply opening 112 of the outer cartridge 111, and the inner circumferential surface of the opening 13 and the inner circumferential surface 120*a* of the seal member 120 are substantially aligned with each other. With this, the toner 15 in the toner cartridge 201 is supplied to the developing unit 109 via the toner replenishing opening 4 provided on the mounting portion 18 of the developing unit 109.

In this state, the adhesion of the toner to the exposable surface 19*b* of the seal sponge 19 is prevented for the reason as described in Embodiment 3. Further, in Embodiment 4, the seal member 120 covers the inner circumferential surface of the toner supply opening 112 and also contacts the shutter 5, and therefore the toner does not adhere to the inner circumferential surface of the toner supply opening 112 of the outer cartridge 111 or to the upper surface and the outer circumferential surface of the seal member 120 of the developing unit 109.

FIG. 17 is a sectional view showing a state where the toner cartridge 201 is detached from the developing unit 109 in Embodiment 4. After the shutter 5 is moved back to the closing position, the toner cartridge 201 is detached from the developing unit 109. In this state, the toner 15 does not adhere to the exposable surface 19*b* of the seal sponge 19 and does not adhere to the inner circumferential surface of the toner supply opening 112 as described above. Further, the toner 15 does not adhere to the upper surface and the outer circumferential surface of the seal member 120 of the developing unit 109.

In Embodiment 4, the outer circumferential surface 120*b* of the seal member 120 is substantially aligned with the inner circumferential surface of the toner supply opening 112. However, Embodiment 4 is not limited to such a configuration, but a similar advantage can be obtained even when an area surrounded by the outer circumferential surface 120*b* of the seal member 120 is smaller than an area surrounded by the inner circumferential surface 120*a*.

As described above, according to the developing device of Embodiment 4, the adhesion of the toner to the exposable surface 19*b* of the seal sponge 19 is prevented, and the adhesion of the toner to the inner circumferential surface of the toner supply opening 112 is also prevented. Therefore, it becomes possible to prevent the toner from being scattered from the toner cartridge 201 can be prevented, and to prevent the toner from contaminating the surroundings. Further, it becomes possible to prevent the toner from remaining on the circumference of the toner replenishing opening 4 of the mounting portion 18 of the developing unit 109.

Embodiment 5

Figure 18:
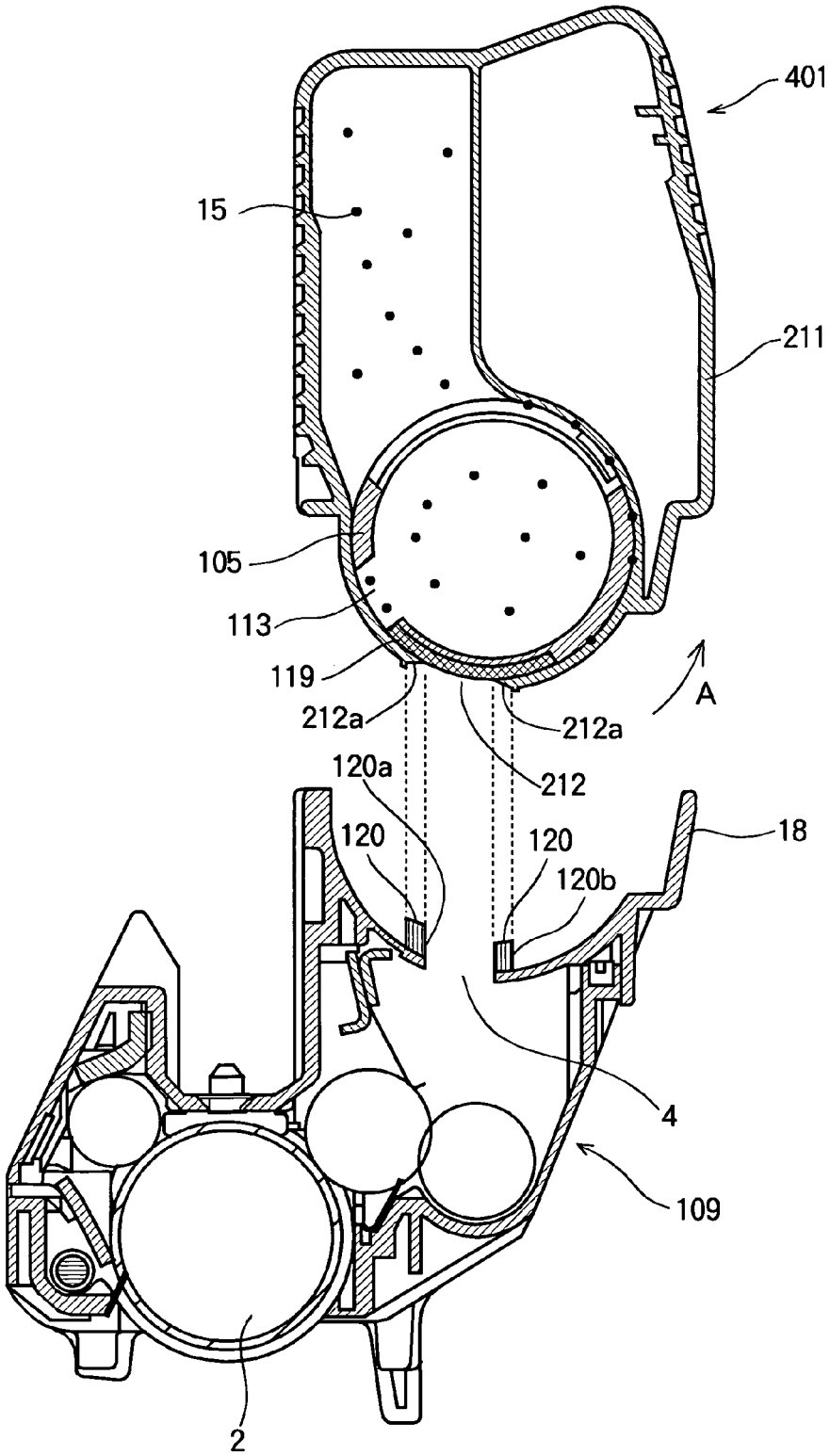
FIG. 18 is a sectional view showing a developing device according to Embodiment 5 in a state where a toner cartridge is detached from a developing unit.

FIG. 18 is a sectional view showing a developing device of an image forming apparatus according to Embodiment 5 of the present invention in a state where the toner cartridge 401 is detached from the developing unit 109.

The image forming apparatus of Embodiment 5 is different from the image forming apparatus 601 (FIG. 1) of Embodiment 1 in employing the developing unit 109 of Embodiment 4 (as the developing unit of Embodiment 5), and employing the toner cartridge 101 of Embodiment 2 (as the toner cartridge 401 of Embodiment 5) while changing the shape of the toner supply opening 212. Therefore, parts of the image forming apparatus of Embodiment 5 that are the same as those of the image forming apparatus 601 of Embodiment 1 (FIG. 1) and the image forming apparatus of Embodiment 2 and 4 (FIGS. 9 and 15) are assigned the same reference numerals. Here, the description is focused on the difference between the difference between the image forming apparatus of Embodiment 5 and the image forming apparatus of Embodiment 1, 2 and 4.

In FIG. 18, the developing unit 109 is configured as was described in Embodiment 5, and therefore description thereof is omitted. The toner cartridge 401 shown in FIG. 18 includes an outer cartridge 211 that stores the toner 15 therein and has a toner supply opening 212. The toner supply opening 212 has a tapered inner surface (i.e., a tapered surface) 212*a*. The tapered inner surface 212*a* has an apex at the inner circumference of the outer cartridge 211 and extends from the apex toward the outside of the outer cartridge 211 so that the tapered inner surface 212*a* faces outside of the outer cartridge 211. An area surrounded by the inner circumference of the tapered inner surface 212*a* is substantially the same as a cross-sectional area of the opening 113 of the shutter 105, and is substantially the same as a cross-sectional area of the inner circumferential surface 120*a* of the seal member 120 of the developing unit 109. An area surrounded by the outer circumference of the tapered surface 212*a* is substantially the same as an area surrounded by the outer circumferential surface 120*b* of the seal member 120.

Figure 19:
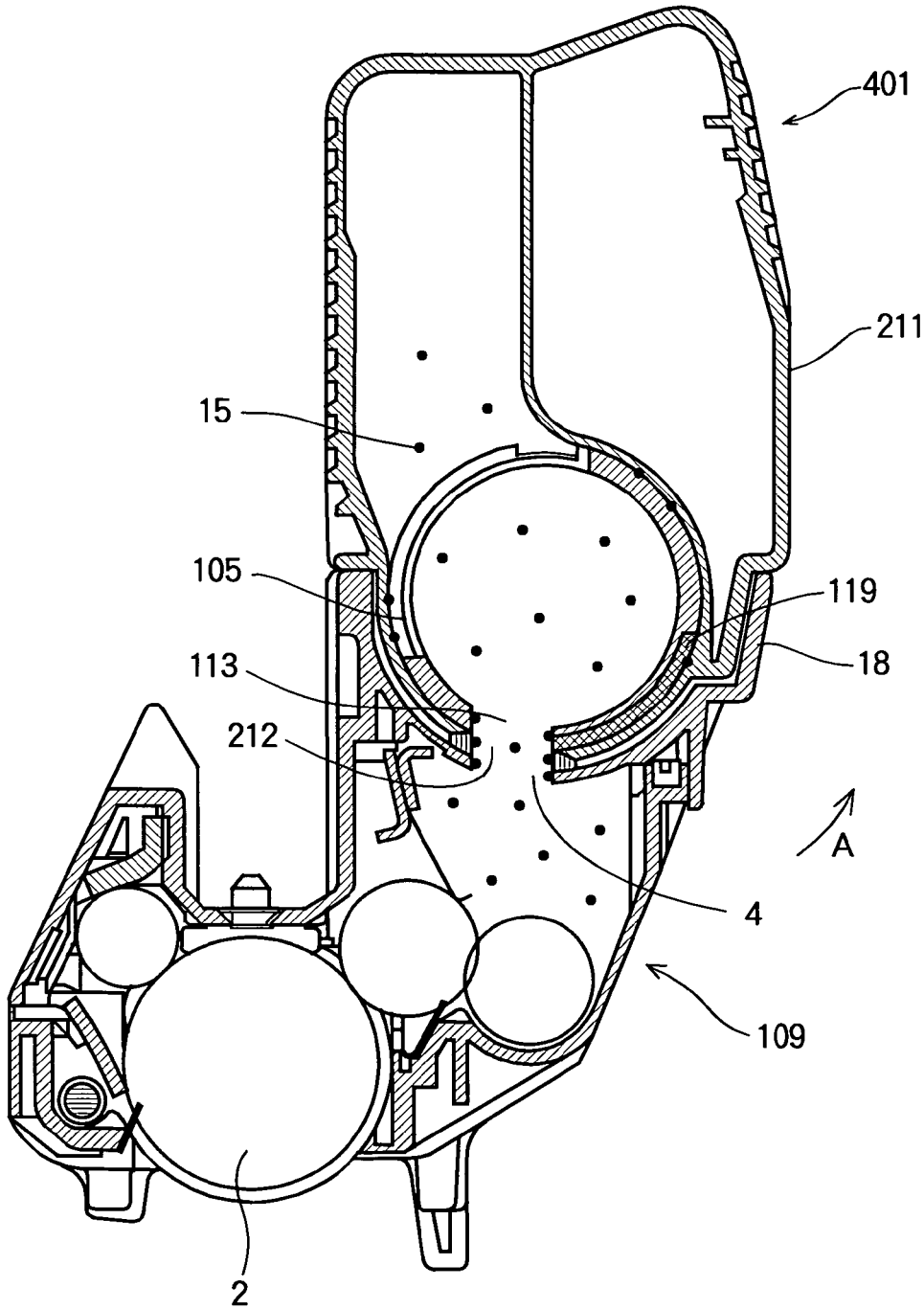
FIG. 19 is a sectional view showing an opening-and-closing operation of a shutter of the toner cartridge according to Embodiment 5.
Figure 20:
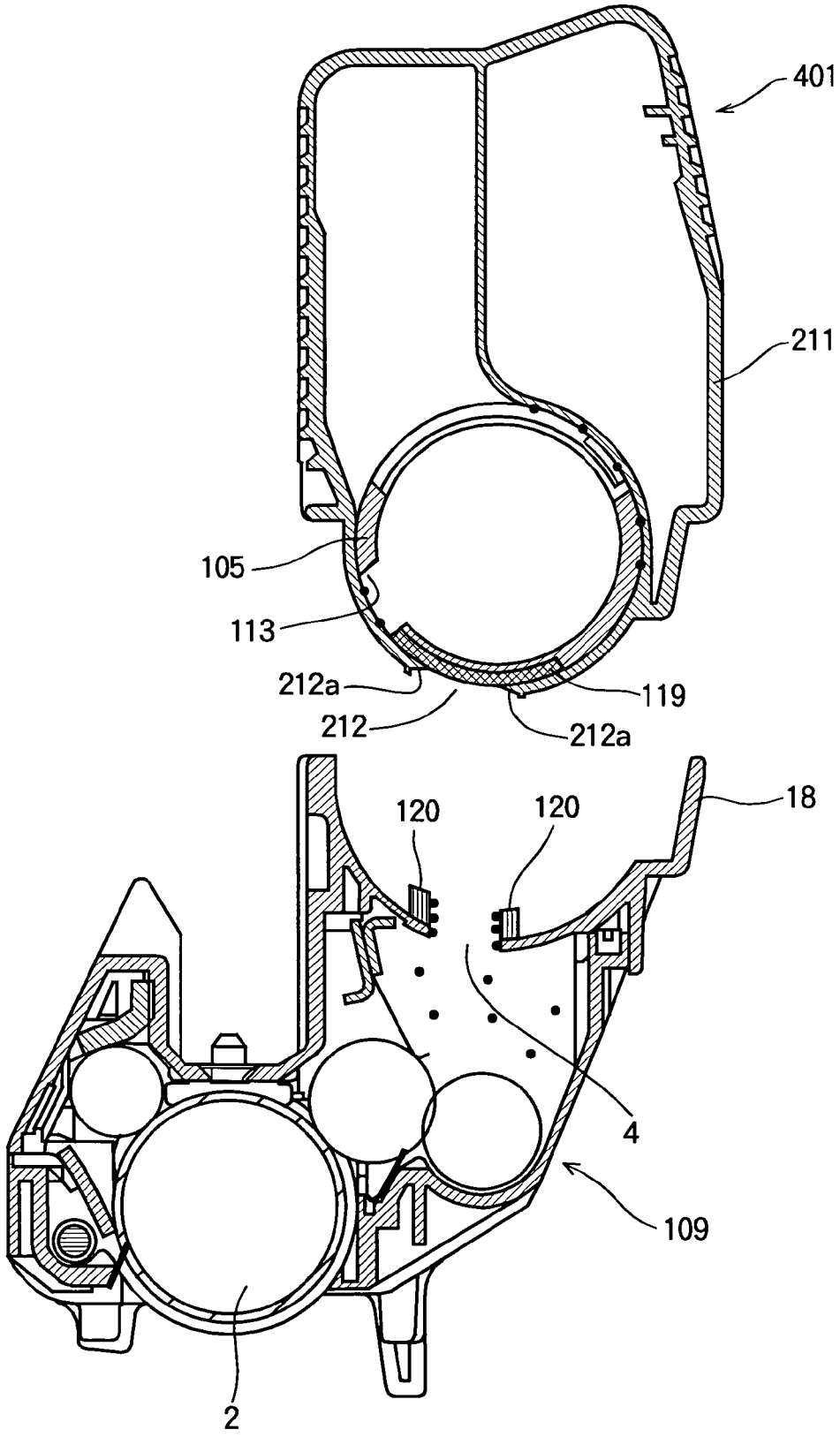
FIG. 20 is a sectional view showing a state where the toner cartridge is detached from the developing unit according to Embodiment 5.

The opening-and-closing operation of the shutter 105 of the above configured toner cartridge 401 will be described with reference to FIG. 18 and FIGS. 19 and 20 showing the respective operation steps.

FIG. 18 shows a state where the toner cartridge 401 and the developing unit 109 are not yet in use and where the shutter 105 of the toner cartridge 401 is in the closing position to close the toner supply opening 212 in Embodiment 5. In this state, the toner supply opening 212 of the outer cartridge 211 (storing the toner 15 therein) of the toner cartridge 401 is closed by the seal sponge 119 of the shutter 105.

FIG. 19 shows a state where the toner cartridge 401 is mounted to the mounting portion 18 of the developing unit 109 in Embodiment 5. In this state, the inner circumference of the tapered inner surface 212*a* of the toner supply opening 212 is substantially aligned with the inner circumferential surface 120*a* of the seal member 120, and the tapered inner surface 212*a* of the toner supply opening 212 contacts the upper surface of the seal member 120, so as to seal between the toner cartridge 401 and the developing unit 109 from outside.

When the shutter 105 is moved by a not shown mechanism in the direction shown by the arrow A from the closing position shown in FIG. 18 to the opening position shown in FIG. 19, the opening 113 of the shutter 105 is substantially aligned with the toner supply opening 212 of the outer cartridge 211, and the toner 15 in the toner cartridge 401 is supplied to the developing unit 109 via the toner replenishing opening 4 provided on the mounting portion 18 of the developing unit 109.

In this state, the upper surface of the seal member 120 contacts the tapered inner surface 212*a* of the toner supply opening 212, and therefore the toner does not adhere to the tapered inner surface 212*a* of the toner supply opening 212, and does not adhere to the upper surface and the outer circumferential surface of the seal member 120 of the developing unit 109.

FIG. 20 shows a state where the toner cartridge 401 is detached from the developing unit 109 in Embodiment 5. After the shutter 105 is moved back to the closing position, the toner cartridge 401 is detached from the developing unit 109. In this state, the toner 15 does not adhere to the tapered inner surface 212*a* of the toner supply opening 212, and does not adhere to the upper surface and the outer circumferential surface of the seal member 120 of the developing unit 109 as described above.

As described above, according to the developing device of Embodiment 5, the adhesion of the toner to the tapered inner surface 212*a* of the toner supply opening 212 is prevented, and therefore it becomes possible to prevent the toner from being scattered from the tapered inner surface 212*a*, and to prevent the toner from contaminating the surroundings. Further, it becomes possible to prevent the toner from remaining on the circumference of the toner replenishing opening 4 of the mounting portion 18 of the developing unit 109.

In Embodiment 5, the shutter 105 with the seal sponge 119 having no extending portion 19*a* (for example, as shown in FIG. 3) is employed. However, Embodiment 5 is not limited to such a configuration. If the shutter 105 with the seal sponge 19 having the extending portion 19*a* (FIG. 3) is employed, it becomes possible to also obtain the advantage such that the toner does not adhere to the exposable surface 19*b* of the seal sponge 19.

Embodiment 6

Figure 21:
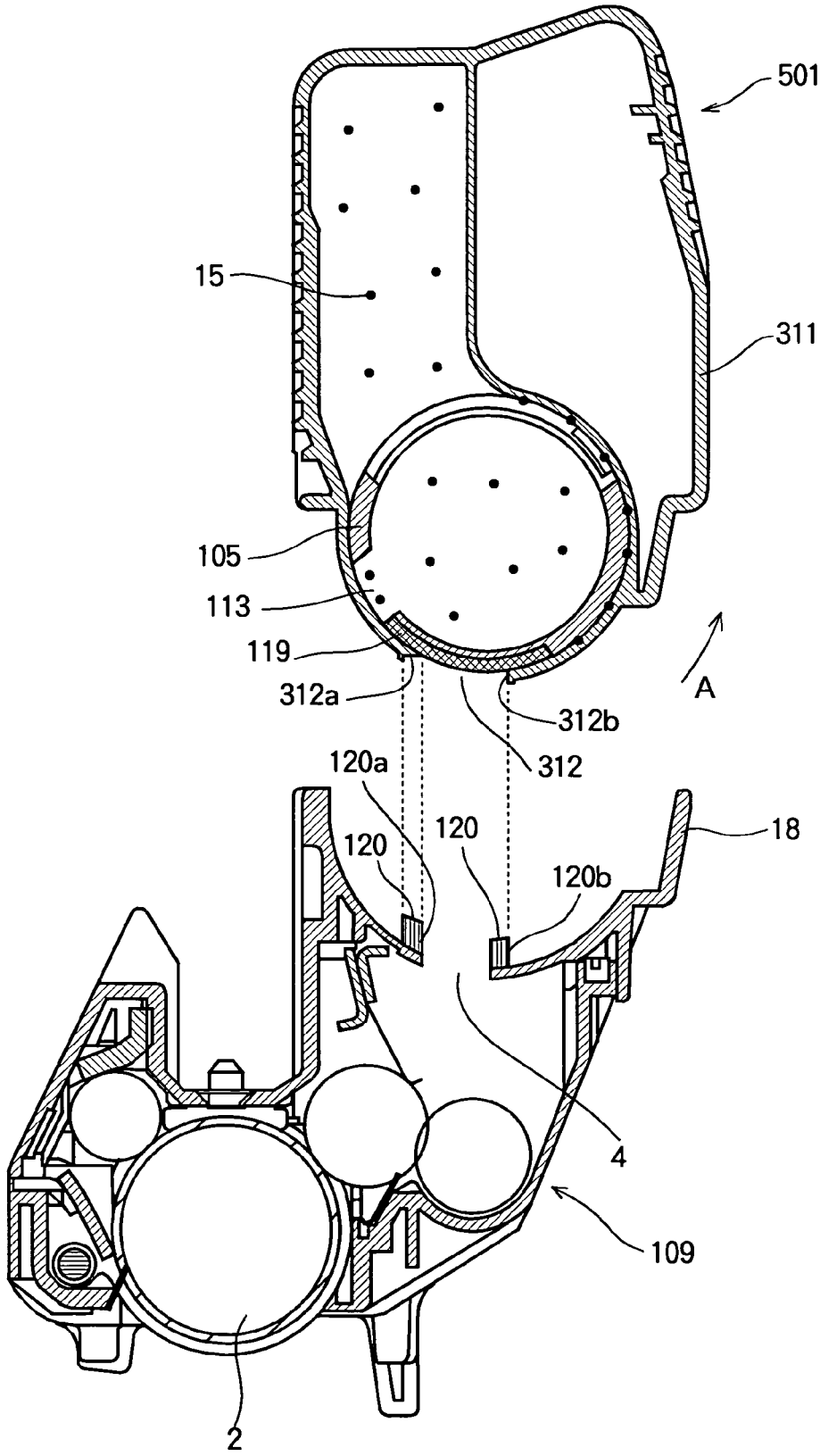
FIG. 21 is a sectional view showing a developing device according to Embodiment 6 in a state where a toner cartridge is detached from a developing unit.

FIG. 21 is a sectional view showing a developing device of an image forming apparatus according to Embodiment 6 of the present invention in a state where a toner cartridge 501 is detached from the developing unit 109.

The image forming apparatus of Embodiment 6 is different from the image forming apparatus 601 (FIG. 1) of Embodiment 1 in employing the developing unit 109 of Embodiment 4 (as the developing unit 109 of Embodiment 6), and employing the toner cartridge 401 of Embodiment 5 (as the toner cartridge 501 of Embodiment 6) while changing the shape of the toner supply opening 312. Therefore, parts of the image forming apparatus of Embodiment 6 that are the same as those of the image forming apparatus 601 of Embodiment 1 (FIG. 1), and the image forming apparatus of Embodiments 4 and 5

(FIGS. 15 and 18) are assigned the same reference numerals. Here, the description is focused on the difference between the difference between the image forming apparatus of Embodiment 6 and the image forming apparatus of Embodiment 1, 4 or 5.

In FIG. 21, the developing unit 109 is configured as was described in Embodiment 4, and therefore description thereof is omitted. The toner cartridge 501 includes an outer cartridge 311 that stores the toner 15 therein and has a toner supply opening 312. A tapered inner surface 312*a* is formed on the upstream side of the toner supply opening 312 in the opening direction of the shutter 105 shown by the arrow A. The tapered inner surface 312*a* has an apex at the inner circumference of the outer cartridge 311 and extends to the outside of the outer cartridge 311 so that the tapered inner surface 312*a* faces outside of the outer cartridge 311.

Figure 22:
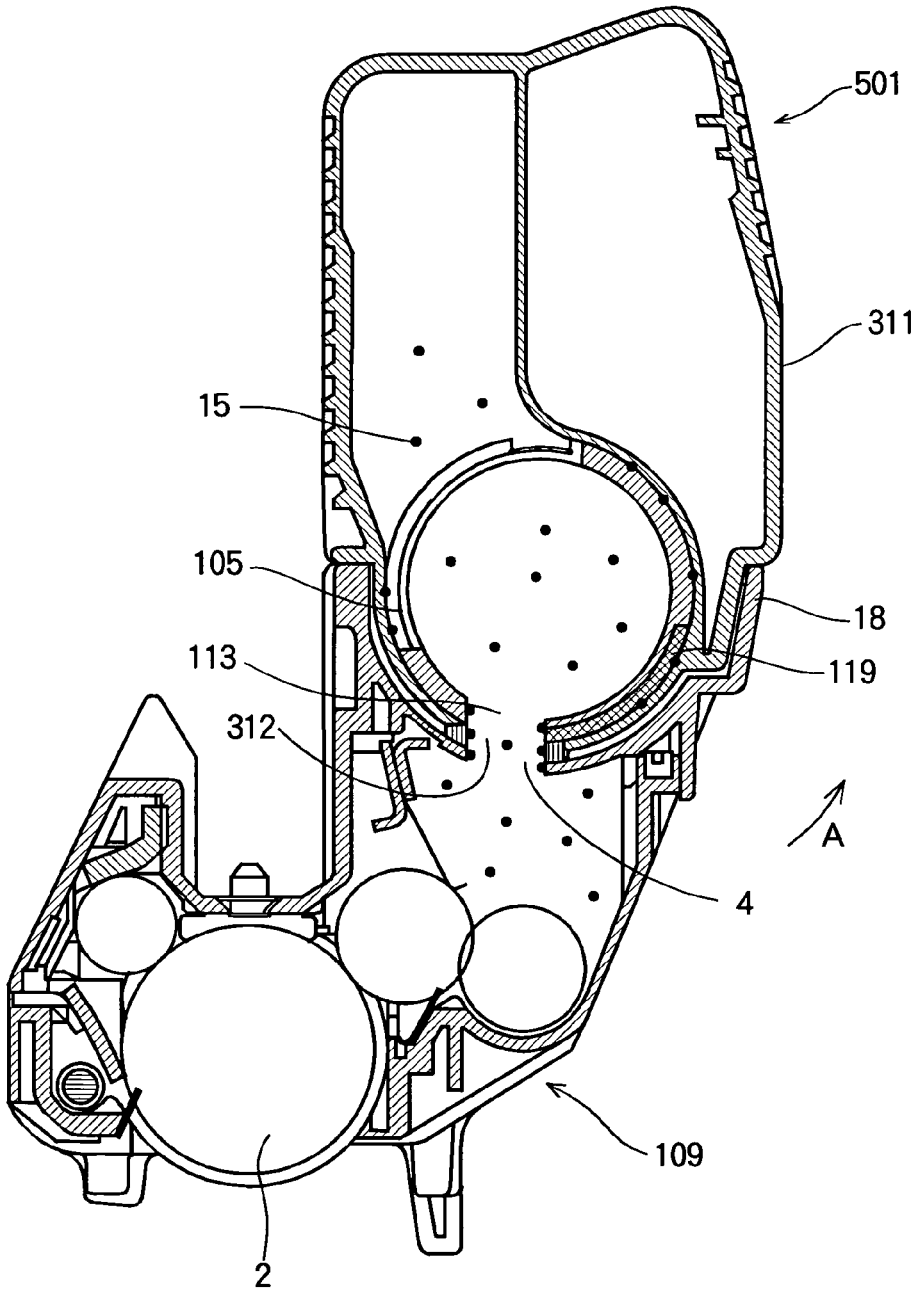
FIG. 22 is a sectional view showing an opening-and-closing operation of a shutter of the toner cartridge according to Embodiment 6.

As shown in FIGS. 21 and 22, when the shutter 105 is in the opening position, the outer circumference of the tapered inner surface 312*a* is substantially aligned with the outer circumference of the seal member 120 of the developing unit 109, and the inner circumference of the tapered inner surface 312*a* is substantially aligned with the inner circumference of the seal member 120 of the developing unit 109 and with the upstream end of the opening 113 in the opening direction of the shutter 105 shown by the arrow A. Further, in this state, an inner circumferential surface 312*b* of the toner supply opening 312 at the downstream side in the opening direction of the shutter 105 (shown by the arrow A) is substantially aligned with the outer circumference of the seal wn by the arrow A) of the opening 113 of the shutter 105.

Figure 23:
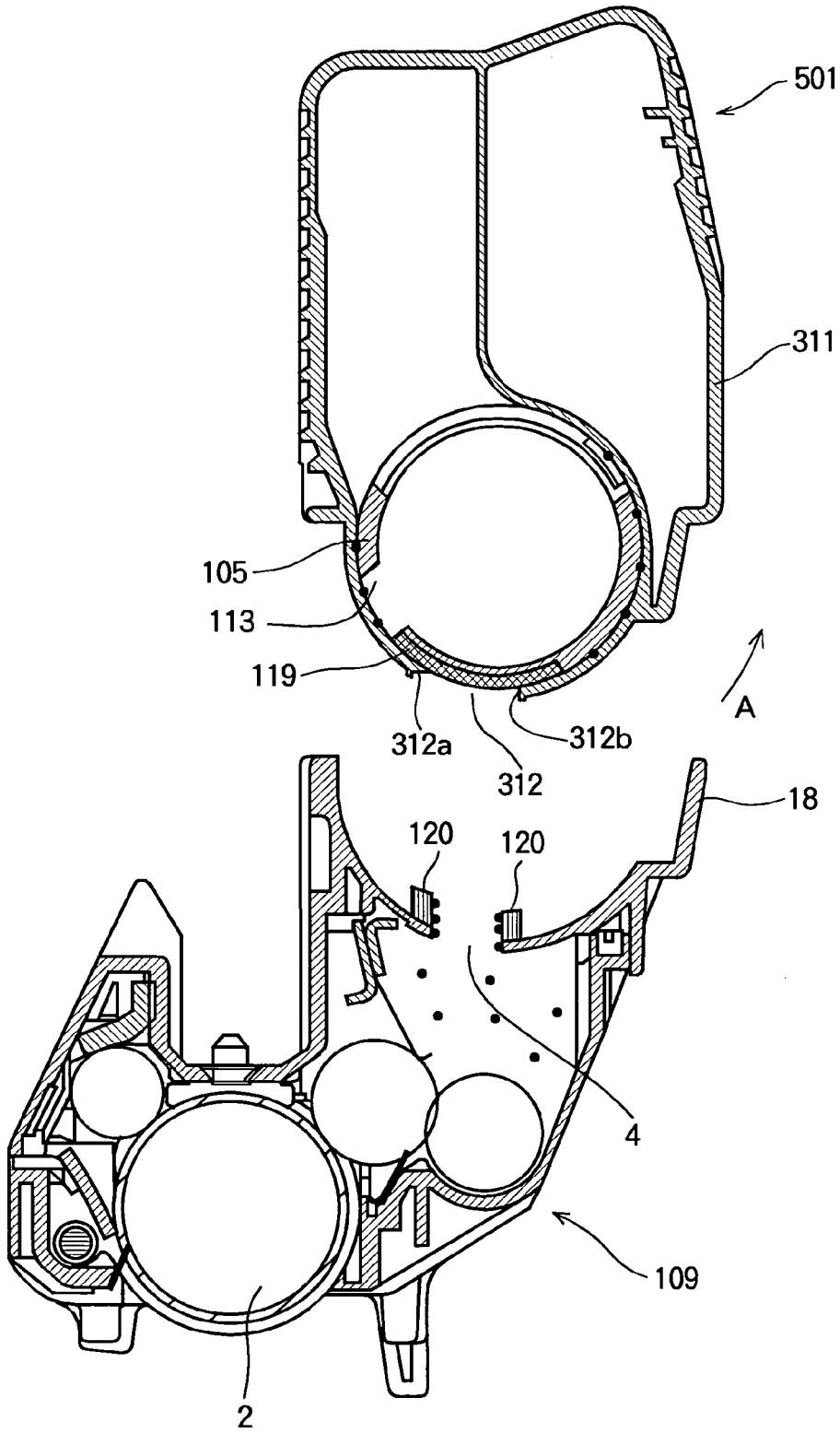
FIG. 23 is a sectional view showing a state where the toner cartridge is detached from the developing unit according to Embodiment 6.

The opening-and-closing operation of the shutter 105 of the toner cartridge 501 will be described with reference to FIG. 21 and FIGS. 22 and 23 showing the respective operation steps.

FIG. 21 shows a state where the toner cartridge 501 and the developing unit 109 are not in use, and where the shutter 105 of the toner cartridge 501 is in the closing position to close the toner supply opening 312 in Embodiment 6. In this state, the toner supply opening 312 of the outer cartridge 311 (storing the toner 15) of the toner cartridge 501 is closed by the seal sponge 119 of the shutter 105.

FIG. 22 is a schematic view showing a state where the toner cartridge 501 is mounted to the mounting portion 18 of the developing unit 109 in Embodiment 6. In this state, the inner circumference of the tapered inner surface 312*a* of the toner supply opening 312 is substantially aligned with the inner circumferential surface 120*a* of the seal member 120, and the tapered inner surface 312*a* of the toner supply opening 312 contacts the upper surface of the seal member 120. At the downstream side of the toner supply opening 312 in the opening direction shown by the arrow A, the seal member 120 of the developing unit 109 is inserted into the toner supply opening 312, and the upper surface of the seal member 120 contacts the seal sponge 119 of the shutter 105 of the toner cartridge 510. With this, the sealing effect is exerted between toner cartridge 501 and the developing unit 109.

When the shutter 105 is moved by a not shown mechanism in the direction shown by the arrow A from the closing position (FIG. 21) to the opening position (FIG. 22), the upstream end of the opening 113 of the shutter 105 (in the opening direction shown by the arrow A) is substantially aligned with the inner circumference of the tapered inner surface 312*a*, and substantially aligned with the inner circumferential surface 120*a* of the seal member 120. Further, in this state, the downstream end of the opening 113 of the shutter 105 (in the opening direction shown by the arrow A) is substantially aligned with the inner circumferential surface 120*a* of the seal member 120 of the developing unit 109. With this, the toner 15 in the toner cartridge 501 is supplied to the developing unit 109 via the toner replenishing opening 4 provided on the mounting portion 18 of the developing unit 109.

In this state, the upper surface of the seal member 120 contacts the tapered inner surface 312*a* of the toner supply opening 312 and contacts the seal sponge 119 of the shutter 105. Therefore, the toner does not adhere to the tapered inner surface 312*a* and the inner circumferential surface 312*b* of the toner supply opening 312 of the outer cartridge 311, and does not adhere to the upper surface and the outer circumferential surface of the seal member 120 of the developing unit 109.

FIG. 23 shows a state where the toner cartridge 501 is detached from the developing unit 109 in Embodiment 6. After the shutter 105 is moved back to the closing position, the toner cartridge 501 is detached from the developing unit 109. In this state, the toner 15 does not adhere to the tapered inner surface 312*a* and does not adhere to the inner circumferential surface 312*b* of the toner supply opening 312 as described above. Further, the toner 15 does not adhere to the upper surface and the outer circumferential surface of the seal member 120 of the developing unit 109.

As described above, according to the developing device of Embodiment 6, the toner does not adhere to the tapered inner surface 312*a* and the inner circumferential surface 312*b* of the toner supply opening 312, and therefore it becomes possible to prevent the toner from being scattered from the tapered inner surface 312*a* and the inner circumferential surface 312*b*, and to prevent the toner from contaminating the surroundings. Further, it becomes possible to prevent the toner from remaining on the circumference of the toner replenishing opening 4 of the mounting portion 18 of the developing unit 109.

In Embodiment 6, the shutter 105 with the seal sponge 119 having no extending portion 19*a* (for example, shown in FIG. 3) is employed. However, Embodiment 6 is not limited to such a configuration. If the shutter 105 with the seal sponge 19 having the extending portion 19*a* (FIG. 3) is employed, it becomes possible to also obtain the advantage such that the toner does not adhere to the exposable surface 19*b* of the seal sponge 19.

In the above described embodiments, examples in which the developing device according to the present invention is applied to the image forming apparatus have been described. However, the present invention is applicable to a copier, a facsimile machine, an MFP (a multifunction peripheral) and the like.

While the preferred embodiments of the present invention have been illustrated in detail, it should be apparent that modifications and improvements may be made to the invention without departing from the spirit and scope of the invention as described in the following claims.

What is claimed is:

1. A developer storing container detachably mounted to a mounting portion of a developing unit, said developer storing container comprising:

a developer storing body that stores a developer therein and has a first opening and a tapered surface formed on said first opening, and a shutter member provided in said developer storing body so that said shutter member is movable along an inner surface of a wall of said developer storing body where said first opening is formed, said shutter member being capable of taking a closing position for closing said first opening and an opening position for opening said first opening, wherein said shutter member comprises a first seal member formed of a resilient material, said first seal member including a seal portion provided at least along said first opening in a state where said shutter member is in said closing position, and an extending portion extending from said seal portion in an opening direction in which said shutter member opens said first opening, and wherein a distance from an end portion of said first opening in said opening direction to an end of said extending portion in a state where said shutter member is in said closing position is longer than a distance moved by an end portion in said opening direction of an exposable portion of said first seal member when said shutter member moves from said closing position to said opening position, said exposable portion being defined as a portion of said first seal member exposed via said first opening in a state where said shutter member is in said closing position, and further wherein in a state where said developer storing container is mounted to said mounting portion, said tapered surface of said developer storing body contacts a second seal member provided on said mounting portion.

2. The developer storing container according to claim 1, wherein said shutter member has a second opening disposed at a position corresponding to said first opening of said developer storing body in a state where said shutter member is in said opening.

3. The developer storing container according to claim 1, wherein said tapered surface is formed on an inner circumferential surface of said first opening, and said tapered surface faces outside of said developer storing body.

4. The developer storing container according to claim 1, wherein said shutter member has a second opening disposed at a position corresponding to said first opening of said developer storing body in a state where said shutter member is in said opening position, wherein an upstream end portion of said first opening in said opening direction is substantially aligned with said second opening, and a downstream end portion of said first opening in said opening direction is disposed at a downstream side of said second opening, in a state where said shutter member is in said opening position, and wherein said tapered surface is formed on said upstream end portion of said first opening, and said tapered surface faces outside of said developer storing body.

5. A developing unit wherein said developer storing container according to claim 2 is detachably mounted to said mounting portion, said mounting portion having a third opening disposed at a position facing said first opening, and has the second seal member provided on a circumference of said third opening, wherein an inner circumference of said second seal member is substantially aligned with said second opening of said shutter member, and said second seal member contacts said shutter member.

6. A developing unit comprising:

a developer storing container detachably mounted to a developing unit, said developer storing container comprising:

a developer storing body that stores a developer therein and has a first opening, and a shutter member provided in said developer storing body so that said shutter member is movable along an inner surface of a wall of said developer storing body where said first opening is formed, said shutter member being capable of taking a closing position for closing said first opening and an opening position for opening said first opening, said shutter member comprising a first seal member that closes said first opening in a state where said shutter member is in said closing position, and a second opening formed at a position facing said first opening of said developer storing body in a state where said shutter member is in said opening position; and a mounting portion to which said developer storing container is detachably mounted, said mounting portion having a third opening disposed at a position facing said first opening, and having a second seal member provided on a circumference of said third opening, wherein, in a state where said developer storing container is mounted to said mounting portion, an inner circumference of said second seal member is substantially aligned with said second opening of said shutter member, and said second seal member contacts said shutter member, and wherein said first opening of said developer storing body is larger than said second opening of said shutter member, and said first opening is larger than said third opening of said mounting portion.

7. A developer storing container detachably mounted to a developing unit, said developer storing container comprising:

a developer storing body that stores a developer therein and has a first opening, and a shutter member provided in said developer storing body so that said shutter member is movable along an inner surface of a wall of said developer storing body where said first opening is formed, said shutter member being capable of taking a closing position for closing said first opening and an opening position for opening said first opening, wherein said shutter member comprises a first seal member including a seal portion provided at least along said first opening in a state where said shutter member is in said closing position, and an extending portion extending from said seal portion in an opening direction in which said shutter member opens said first opening, and wherein a distance from an end portion of said first opening in said opening direction to an end of said extending portion in a state where said shutter member is in said closing position is longer than a distance moved by an end portion in said opening direction of an exposable portion of said first seal member when said shutter member moves from said closing position to said opening position, said exposable portion being defined as a portion of said first seal member exposed via said first opening in a state where said shutter member is in said closing position, wherein said shutter member has a second opening disposed at a position corresponding to said first opening of said developer storing body in a state where said shutter member is in said opening position, and wherein said second opening is smaller than said first opening; and a mounting portion to which said developer storing container is detachably mounted, said mounting portion has a third opening disposed at a position facing said first opening, and has a second seal member provided on a circumference of said third opening, wherein, in a state where said developer storing container is mounted to said mounting portion, an inner circumference of said second seal member is substantially aligned with said second opening of said shutter member, and said second seal member contacts said shutter member, and wherein an area surrounded by an outer circumference of said second seal member is smaller than a cross-sectional area of said first opening of said developer storing body.

8. A developing unit comprising:

a developer storing container detachably mounted to a developing unit, said developer storing container comprising:

a developer storing body that stores a developer therein and has a first opening, and a shutter member provided in said developer storing body so that said shutter member is movable along an inner surface of a wall of said developer storing body where said first opening is formed, said shutter member being capable of taking a closing position for closing said first opening and an opening position for opening said first opening, said shutter member comprising a first seal member that closes said first opening in a state where said shutter member is in said closing position, and a second opening formed at a position facing said first opening of said developer storing body in a state where said shutter member is in said opening position, and wherein said second opening is smaller than said first opening; and a mounting portion to which said developer storing container is detachably mounted, said mounting portion having a third opening disposed at a position facing said first opening, and having a second seal member provided on a circumference of said third opening, wherein, in a state where said developer storing container is mounted to said mounting portion, an inner circumference of said second seal member is substantially aligned with said second opening of said shutter member, and said second seal member contacts said shutter member, and wherein an area surrounded by an outer circumference of said second seal member is smaller than a cross-sectional area of said first opening of said developer storing body.

9. A developer storing container detachably mounted to a mounting portion of a developing unit, said developer storing container comprising:

a developer storing body that stores a developer therein and has a first opening, and a shutter member provided in said developer storing body so that said shutter member is movable in contact with an inner surface of a wall of said developer storing body where said first opening is formed, said shutter member being capable of taking a closing position for closing said first opening and an opening position for opening said first opening, wherein said shutter member comprises a first seal member that closes said first opening in a state where said shutter member is in said closing position, further wherein a tapered surface is formed on an inner circumference of said first opening, and said tapered surface faces outside of said developer storing body, further wherein an obtuse angle is formed between said tapered surface and a tangential line of said first seal member at a position proximate to said inner circumferences of said first opening, and further wherein in a state where said developer storing container is mounted to said mounting portion, said tapered surface of said developer storing body contacts a second seal member provided on said mounting portion.

10. A developing unit wherein said developer storing container according to claim 3 is detachably mounted to the mounting portion, wherein said mounting portion has a third opening disposed at a position facing said first opening, and has a second seal member provided on a circumference of said third opening, wherein an inner circumference of said second seal member is substantially aligned with said first opening of said developer storing body.

11. A developing unit wherein said developer storing container according to claim 9 is detachably mounted to said mounting portion, wherein said mounting portion has a third opening disposed at a position facing said first opening, and has a second seal member provided on a circumference of said third opening, wherein an inner circumference of said second seal member is substantially aligned with said first opening of said developer storing body.

12. A developer storing container detachably mounted to a mounting portion of a developing unit, said developer storing container comprising:

a developer storing body that stores a developer therein and has a first opening, and a shutter member provided in said developer storing body so that said shutter member is movable in contact with an inner surface of a wall of said developer storing body where said first opening is formed, said shutter member being capable of taking a closing position for closing said first opening and an opening position for opening said first opening, wherein said shutter member comprises a first seal member that closes said first opening in a state where said shutter member is in said closing position, and has a second opening disposed at a position corresponding to said first opening of said developer storing body in a state where said shutter member is in said opening position, wherein an upstream end portion of said first opening in said opening direction is substantially aligned with said second opening, and a downstream end portion of said first opening in said opening direction is disposed at a downstream side of said second opening, in a state where said shutter member is in said opening position, and wherein a tapered surface is formed on said upstream end portion of said first opening, and said tapered surface faces outside of said developer storing body, wherein an obtuse angle is formed between said tapered surface and a tangential line of said first seal member at a position proximate to said inner circumferences of said first opening, further wherein in a state where said developer storing container is mounted to said mounting portion, said tapered surface of said developer storing body contacts a second seal member provided on said mounting portion.

13. A developing unit wherein said developer storing container according to claim 4 is detachably mounted to the mounting portion, wherein said mounting portion has a third opening disposed at a position facing said first opening, and has a second seal member provided on a circumference of said third opening, wherein, at a downstream side of said second opening of said shutter member, a downstream end portion of said second opening in said opening direction is substantially aligned with an inner circumference of said second seal member, and said second seal member contacts said shutter member and wherein, at an upstream side of said second opening of said shutter member, said inner circumference of said second seal member is substantially aligned with said first opening.

14. A developing unit wherein said developer storing container according to claim 12 is detachably mounted to the mounting portion, wherein said mounting portion has a third opening disposed at a position facing said first opening, and has a second seal member provided on a circumference of said third opening, wherein, at a downstream side of said second opening of said shutter member, a downstream end portion of said second opening in said opening direction is substantially aligned with an inner circumference of said second seal member, and said second seal member contacts said shutter member and wherein, at an upstream side of said second opening of said shutter member, said inner circumference of said second seal member is substantially aligned with said first opening.

15. A developing device comprising said developer storing container according to claim 2 and a developing unit wherein said developer storing container is detachably mounted to the mounting portion, wherein said mounting portion has a third opening disposed at a position facing said first opening, and has a second seal member provided on a circumference of said third opening, wherein an inner circumference of said second seal member is substantially aligned with said second opening of said shutter member, and said second seal member contacts said shutter member.

16. A developing device comprising said developer storing container according to claim 3 and a developing unit, wherein said developer storing container is detachably mounted to the mounting portion, wherein said mounting portion has a third opening disposed at a position facing said first opening, and has a second seal member provided on a circumference of said third opening, an inner circumference of said second seal member is substantially aligned with said second opening of said shutter member, and said second seal member contacts said shutter member.

17. A developing device comprising said developer storing container according to claim 9 and a developing unit wherein said developer storing container is detachably mounted to the mounting portion, wherein said mounting portion has a third opening disposed at a position facing said first opening, and has a second seal member provided on a circumference of said third opening, wherein an inner circumference of said second seal member is substantially aligned with said second opening of said shutter member, and said second seal member contacts said shutter member.

18. A developing device comprising said developer storing container according to claim 4 and a developing unit wherein said developer storing container is detachably mounted to said mounting portion, said mounting portion having a third opening disposed at a position facing said first opening, and having a second seal member provided on a circumference of said third opening, wherein, at a downstream side of said second opening of said shutter member, a downstream end portion of said second opening in said opening direction is substantially aligned with an inner circumference of said second seal member, and said second seal member contacts said shutter member and wherein, at an upstream side of said second opening of said shutter member, an inner circumference of said second seal member is substantially aligned with said first opening of said developer storing body.

19. A developing device comprising said developer storing container according to claim 12 and a developing unit wherein said developer storing container is detachably mounted to said mounting portion, said mounting portion having a third opening disposed at a position facing said first opening, and having a second seal member provided on a circumference of said third opening, wherein, at a downstream side of said second opening of said shutter member, a downstream end portion of said second opening in said opening direction is substantially aligned with an inner circumference of said second seal member, and said second seal member contacts said shutter member and wherein, at an upstream side of said second opening of said shutter member, an inner circumference of said second seal member is substantially aligned with said first opening of said developer storing body.

20. An image forming apparatus comprising said developing device according to claim 15.

21. An image forming apparatus comprising said developing device according to claim 6.

22. An image forming apparatus comprising said developing device according to claim 16.

23. An image forming apparatus comprising said developing device according to claim 17.

24. An image forming apparatus comprising said developing device according to claim 18.

25. An image forming apparatus comprising said developing device according to claim 19.

26. A developer storing container detachably mounted to a developing unit, said developer storing container comprising:

a developer storing body that stores a developer therein and has a first opening, and a shutter member provided in said developer storing body so that said shutter member is movable in contact with an inner surface of a wall of said developer storing body where said first opening is formed, said shutter member being capable of taking a closing position for closing said first opening and an opening position for opening said first opening, wherein said shutter member comprises a first seal member that closes said first opening in a state where said shutter member is in said closing position, and a has a second opening disposed at a position corresponding to said first opening of said developer storing body in a state where said shutter member is in said opening position, wherein an upstream end portion of said first opening in said opening direction is substantially aligned with said second opening, and a downstream end portion of said first opening in said opening direction is disposed at a downstream side of said second opening, in a state where said shutter member is in said opening position, and wherein a tapered surface is formed on said upstream end portion of said first opening, and said tapered surface faces outside of said developer storing body, wherein an obtuse angle is formed between said tapered surface and a tangential line of said first seal member at a position proximate to said inner circumferences of said first opening, and wherein the tapered surface is formed only on said upstream end portion of said first opening.

27. The developer storing container according to claim 1, wherein the tapered surface is separate from the shutter member such that the tapered surface is not movable with the shutter member, further wherein the developer storing container is mounted to said mounting portion and the tapered surface contacts the second seal member in every position of the shutter member.

28. The developer storing container according to claim 9, wherein the tapered surface is separate from the shutter member such that the tapered surface is not movable with the shutter member, further wherein the developer storing container is mounted to said mounting portion and the tapered surface contacts the second seal member in every position of the shutter member.

29. The developer storing container according to claim 12, wherein the tapered surface is separate from the shutter member such that the tapered surface is not movable with the shutter member, further wherein the developer storing container is mounted to said mounting portion and the tapered surface contacts the second seal member in every position of the shutter member.

* * * * *